US005305619A

United States Patent [19]

Shima et al.

[11] Patent Number: 5,305,619

[45] Date of Patent: Apr. 26, 1994

[54] STITCH INCREASING METHOD AND CAMS FOR FLAT KNITTING MACHINE HAVING STITCH INCREASING FUNCTION

[75] Inventors: Masahiro Shima; Masaki Miyamoto, both of Wakayama, Japan

[73] Assignee: Shima Seiki Mfg. Ltd., Wakayama, Japan

[21] Appl. No.: 672,860

[22] Filed: Mar. 20, 1991

[30] Foreign Application Priority Data

Mar. 26, 1990 [JP] Japan ..... 2-76147
May 16, 1990 [JP] Japan ..... 2-127845

[51] Int. Cl.[5] ..... D04B 7/10
[52] U.S. Cl. ..... 66/70; 66/76
[58] Field of Search ..... 66/70, 75 R, 71, 73, 66/76, 69, 120, 64, 96 R, 200, 78

[56] References Cited

U.S. PATENT DOCUMENTS 1,676,947 7/1928 Frazier ..... 66/96 R
2,616,275 11/1952 Bennington ..... 66/70
4,012,927 3/1977 Kühnert ..... 66/78
4,637,228 1/1987 Shima ..... 66/120 X

FOREIGN PATENT DOCUMENTS 3003811 2/1980 Fed. Rep. of Germany ..... 66/77
202223 1/1939 Sweden ..... 66/75 R
196613 8/1981 Sweden ..... 66/75 R

*Primary Examiner*—Clifford D. Crowder
*Assistant Examiner*—Larry D. Worrell, Jr.
*Attorney, Agent, or Firm*—Barnes, Kisselle, Raisch, Choate, Whittemore & Hulbert

[57] ABSTRACT

A stitch increasing method and a needle operating cam for a flat knitting machine having stitch increasing function. The needle operating cam for operating needle bodies and sliders of compound needles separately from each other, in which in relation to a lowering face of a needle body lowering cam of a loop delivering side cam, a slider lowering face for lowering a slider at a timing earlier than that by the lowering face of the needle body lowering cam is provided.

5 Claims, 21 Drawing Sheets

STITCH INCREASING METHOD AND CAMS FOR FLAT KNITTING MACHINE HAVING STITCH INCREASING FUNCTION

FIELD OF THE INVENTION

The present invention relates to a stitch increasing method for increasing a stitch during forming stitches and a needle operating cam which can increase a stitch.

RELATED ART STATEMENT

Conventionally, when a knit fabric is to be knit by hand knitting, such stitch increasing as illustrated in FIG. 18 (the example shown is left stitch increasing, and similarly there is right stitch increasing) and such cast-on stitch increasing as shown in FIG. 19 are known, and they are used when, for example, the knitting width is to be increased as in fashioning or when Aran pattern is to be produced or the like. However, an automatic knitting machine on which such knitting methods can be effected is not known as yet.

OBJECT AND SUMMARY OF THE INVENTION

It is an object of the present invention to obtain, in view of such regards as described above, an automatic knitting machine which can effect stitch increasing which has not conventionally been achieved on an automatic knitting machine.

According to a method of the present invention, among compound needles inserted in needle grooves of first and second needle beds disposed with ends thereof opposed to each other, that needle in either one of the first and second needle beds which has a loop carried thereon is raised to a transfer position, and then another needle in the opposing needle bed is raised until it is inserted into the loop carried on the former needle whereafter the two needles are lowered to cause the knit fabric loop to be caught by the hook of the latter needle, and then, when the needle which has been lifted to the transfer position is lowered, the loop carried on the needle being lowered is caught again in the hook of the needle being lowered so that the loop extends between the needles in the first and second needle beds.

According to a cam of the present invention, a needle operating cam for a flat knitting machine which has a knitting lock and a transfer lock for operating needle bodies and sliders of compound needles separately from each other, is constituted such that, for a lowering face of a needle body lowering cam of a stitch transferring side cam of the transfer lock, a slider lowering face for lowering a slider at a timing earlier than that by the lowering face of the needle body lowering cam is provided.

As the needle operating cam for accomplishing the stitch increasing method of the present invention, other needle operating cams for a flat knitting machine mentioned hereinafter may be used besides the above needle operating cam including the knitting lock and the transfer lock. A needle operating cam for a flat knitting machine for operating needle bodies and sliders of compound needles separately from each other is constructed such that, for a lowering face of a needle body lowering cam of a stitch transfer side cam, a slider lowering face for lowering a slider at a timing earlier than that by the lowering face of the needle body lowering cam is provided. Or, a needle operating cam for a flat knitting machine which has a knitting lock and operates for needle bodies and sliders of compound needles separately from each other is constructed such that, for a lowering face of a needle body lowering cam of a stitch transfer cam, a slider lowering face for lowering a slider at a timing earlier than that by the lowering face of the needle body lowering cam is provided. Or else, a needle operating cam for a flat knitting machine which has a transfer lock and operates needle bodies and sliders of compound needles separately from each other is constructed such that, for a lowering face of a needle body lowering cam of a loop delivering side cam, a slider lowering face for lowering a slider at a timing earlier than that by the lowering face of the needle body lowering cam is provided.

With the construction described above, a loop being knit is caught by the hook of the needle body which is opened as the slider is lowered at a timing earlier than the lowering movement of the needle body, and an increased stitch can be knit.

BRIEF DESCRIPTION OF THE DRAWINGS

FIGS. 1 to 17 show an apparatus for putting the method of the present invention into practice and a knit fabric knitted in accordance with the method of the present invention, and FIG. 1 shows a cam lock of a carriage as viewed from below, FIG. 2 is a side elevational view showing a needle, a select jack, a selector and a select jack presser placed at positions corresponding to the cam lock, FIGS. 3 and 4 are bottom plan views of the cam lock showing loci of needles on the delivering side and receiving side upon transfer, ① and ⑤ of FIG. 5 are side elevational views of needles illustrating a loop delivering procedure upon transfer, FIG. 6 is a plan view of loops produced according to the method of the present invention, FIG. 7 is an illustrative view of loops and needles, FIGS. 10, 12, 14 and 16 are views of textures of knit fabrics produced in accordance with the present invention, 1 to 8 of FIG. 11, 1 to 8 of FIG. 13, 1 to 8 of FIG. 15 and 1 to 8 of FIG. 17 are illustrative views showing procedures of knitting of the textures shown in FIGS. 10, 12, 14 and 16, respectively;

Figure 25:
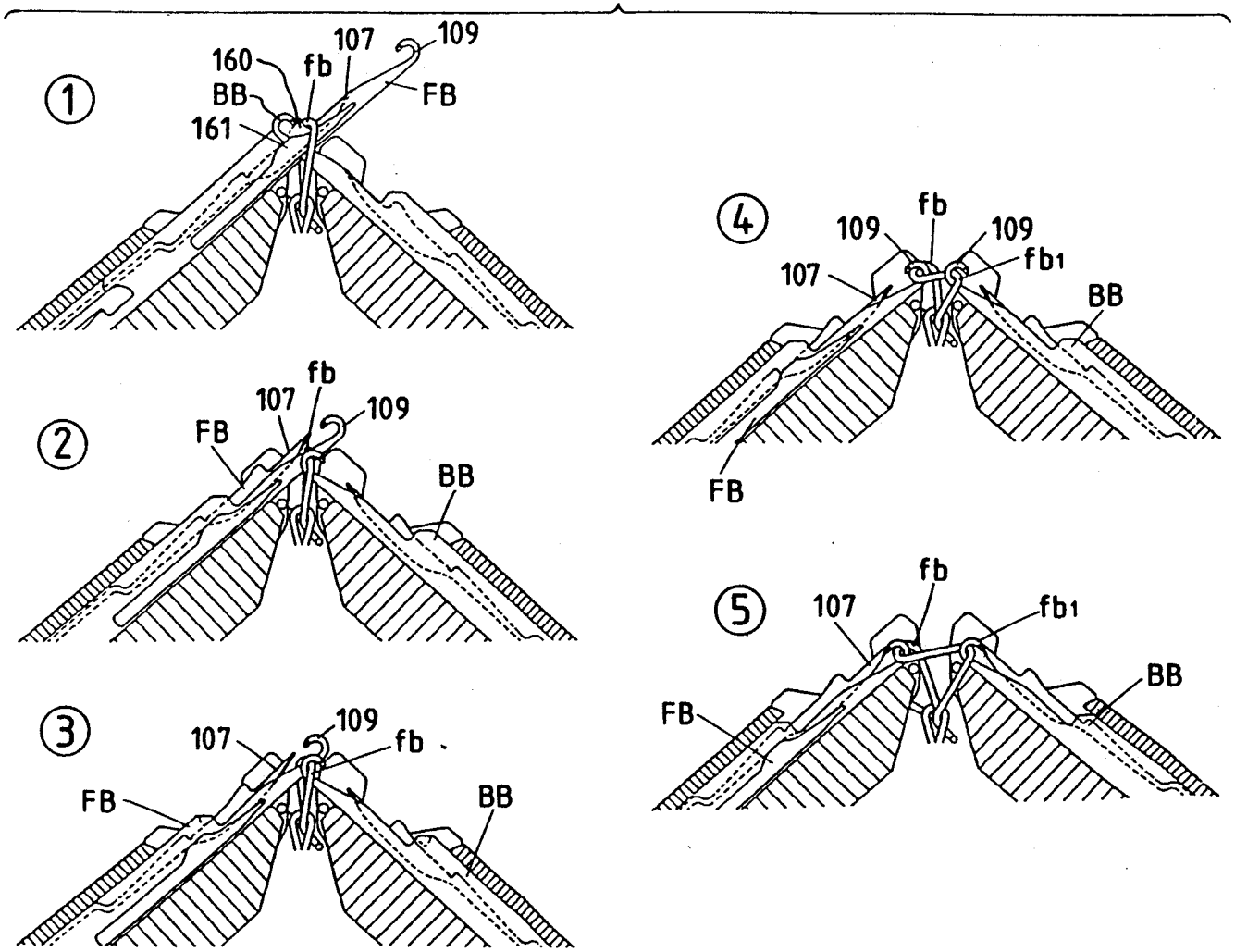
Figure 26A:
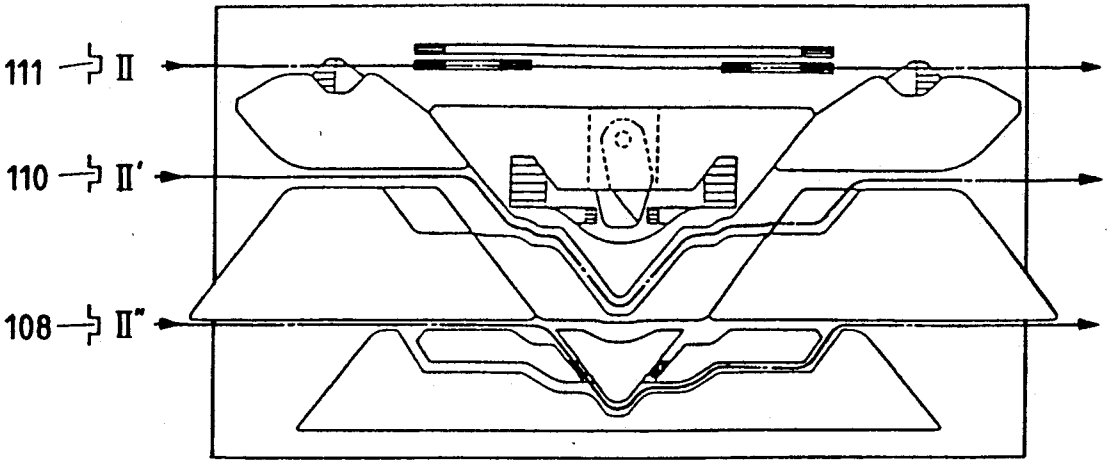
Figure 26B:
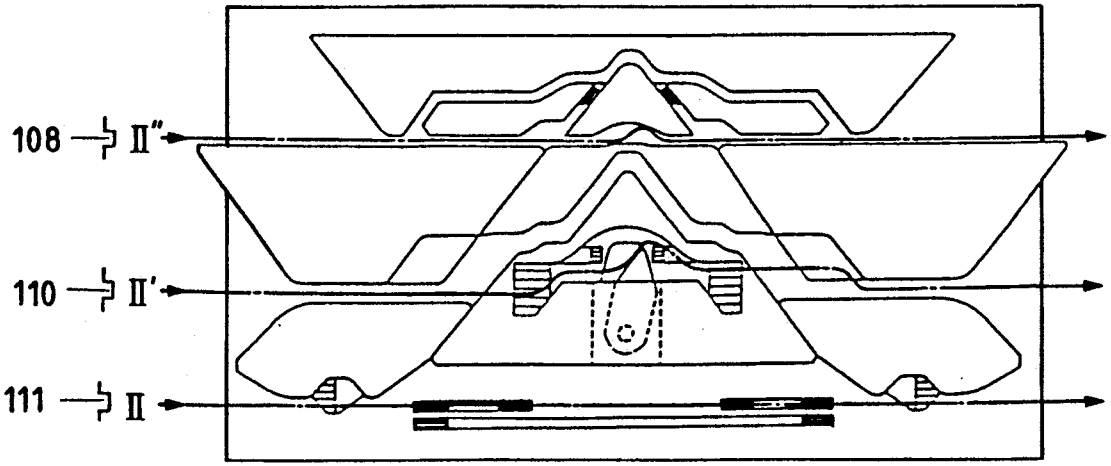
Figure 27A:
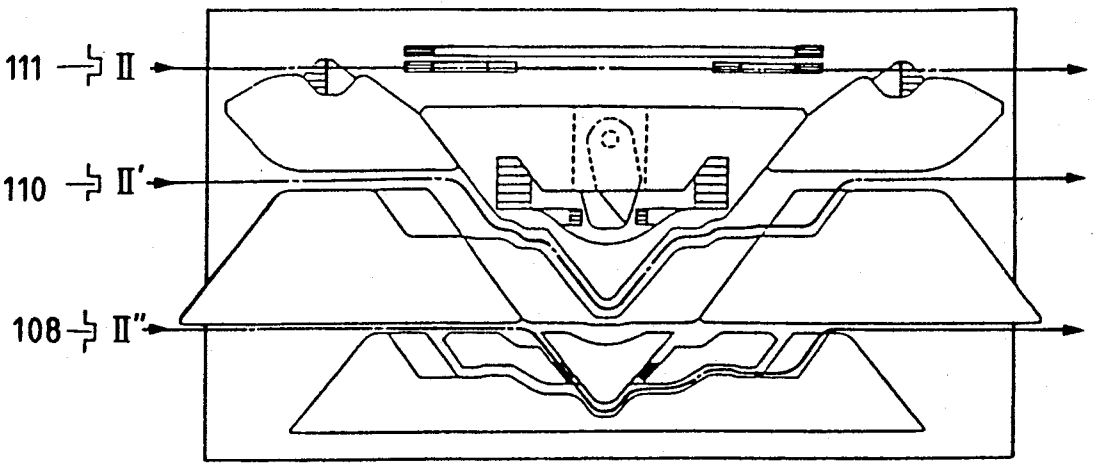
Figure 27B:
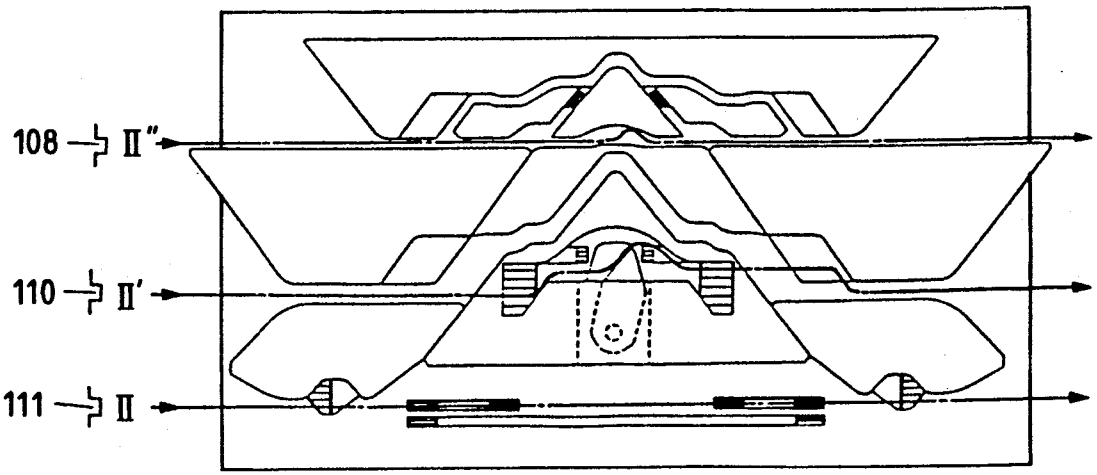

① to ⑤ of FIG. 25 are side elevational views of needles illustrating a loop delivering procedure upon increasing of a stitch;

FIG. 26*a* and FIG. 26*b* are bottom plan views of the cam locks showing loci of needles on the delivering side and receiving side of the needle operating cam for a flat knitting machine of the third embodiment; and FIG. 27*a* and FIG. 27*b* are bottom plan views of the cam locks showing loci of needles on the delivering side and receiving side of the fourth embodiment.

DETAILED DESCRIPTION OF PREFERRED EMBODIMENT

An embodiment of a method of the present invention and a needle operating cam for a flat knitting machine for putting the method of the present invention into practice will be described below.

Figure 1:
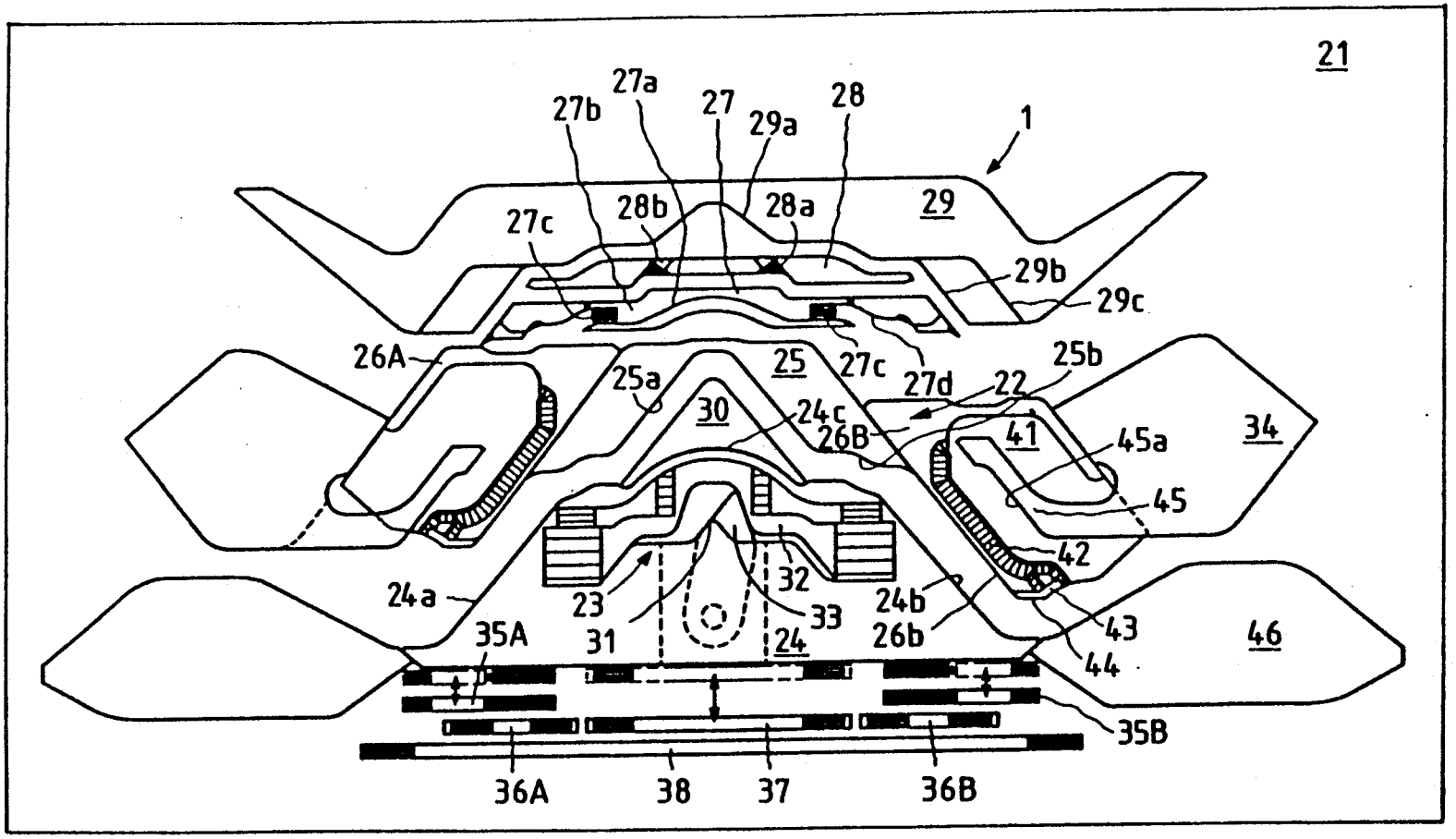
Figure 2:
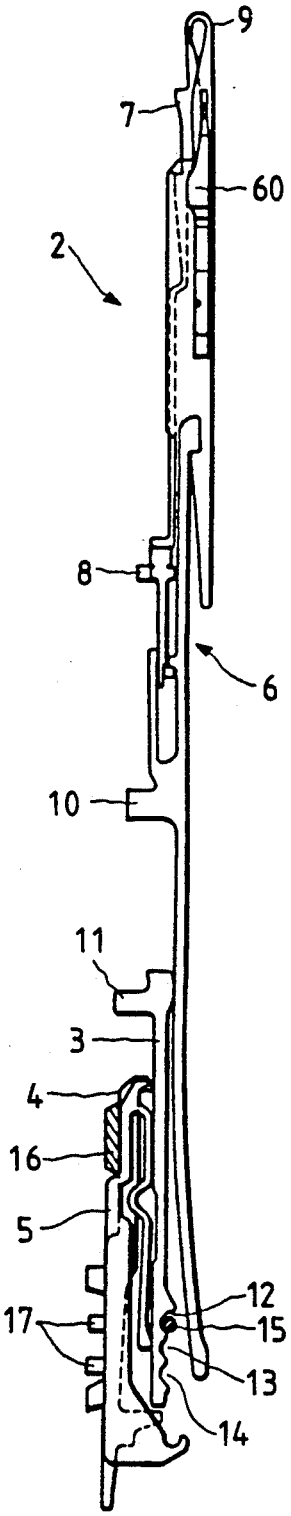

FIG. 1 shows a condition of a cam lock 1 of a carriage as viewed from below, and FIG. 2 shows a side elevation of a needle 2, a select jack 3, a selector 4, a select jack presser 5 and so forth placed at positions corresponding to the cam lock 1.

The needle 2 used in the arrangement of the present invention is a compound needle, and a slider 7 is slidably fitted at an upper portion of an end of a needle body 6 such that a hook 9 of the needle body 6 may be opened or closed by the slider 7 by operating a slider butt 8. Reference numeral 10 denotes a needle butt provided on the needle body 6. A select jack butt 11 has recesses 12, 13 and 14 provided at a base portion thereof such that they may be selectively engaged with a wire 15 extending through a needle bed (not shown) to define a position of the select jack butt 11. When the wire 15 is engaged with the recess 12, the select jack butt 11 is positioned at its welt position; when the wire 15 is engaged with the recess 13, the select jack butt 11 is positioned at its tuck position; and when the wire 15 is engaged with the recess 14, the select jack butt 11 is positioned at its knit position. The select jack presser 5 is a resilient plate member having a channel-shape side elevation and is engaged at an upper edge thereof with a band plate 16 inserted in and extending through the needle bed (not shown) to press at an end portion thereof against the select jack 3 to urge the select jack butt 11 in a direction to move upwardly. Reference numeral 17 denotes a selector butt of the selector 4.

The lock 1 is composed of a knitting lock 22 and a transfer lock 23 provided on a cam plate 21.

The knitting lock 22 is constituted from a needle raising cam 24 having a trapezoidal shape wherein the opposite side inclined faces serve as raising cam faces 24*a* and 24*b*. A trapezoidal transfer guide cam 25 is disposed on the same center line as the needle raising cam 24 and has a mountain-shaped concave cam face 25*a*. A pair of left and right knitting cams 26A and 26B are provided for up and down sliding movement in a truncated inverted V-shaped arrangement on the opposite sides of the transfer guide cam 25 and needle raising cam 24, and a lower slider guide cam 27, a middle slider guide cam 28 and an upper slider guide cam 29 are provided at three stages above the transfer guide cam 25. The lower slider guide cam 27 has a bow-shaped arcuate face 27*a* provided at the center of a lower portion thereof and having the same shape as a bow-shaped arcuate needle butt raising face 24*c* provided at a top portion of the needle raising cam 24, a slider butt path 27*b* of a half height contiguous to the bow-shaped arcuate face 27*a*, a pair of inclined faces 27*c* at the opposite ends of the slider butt path 27*b*, and a pair of slider lowering inclined faces 27*d*. The middle slider guide cam 28 is located above the lower slider guide cam 27 and has a pair of raising inclined faces 28*a* and a pair of butt paths 28*b* of a half height disposed in a truncated inverted V-shape at intermediate portions thereof. The upper slider guide cam 29 is located above the middle slider guide cam 28 and has a transfer guide face 29*a* formed to define a moutain-shaped recessed portion at a mid portion thereof, and the opposite ends of the upper slider guide cam 29 fall in such a configuration that they cover over the opposite sides of the middle slider guide cam 28 and lower slider guide cam 27 and form a pair of lowering guide faces 29*b*. The lowering guide faces 29*b* have a half height, and loop increasing lowering guide faces 29*c* are provided in parallel to the lowering guide faces 29*b*. The loop increasing lowering guide faces 29*c* have a full height.

The transfer lock 23 is located adjacent a top portion of a trapezoidal shape of the needle raising cam 24 and has formed thereon a loop delivering raising cam 30 which has a trapezoidal shape and has a height sufficient to raise the needle 2 to its loop delivering position, a mountain-shaped cam face 31 formed at the center of the needle raising cam 24, a loop receiving needle raising cam 33 of a half height provided for rocking motion into a recessed portion 32 in which it is sunk from a plane of the cam plate 21, and a transfer guide cam 25. Reference numeral 34 denotes a fixed guide cam.

Located below the raising cam 24 are a pair of pressers 35A and 35B which act upon the select jack butt 11 at its knit position to sink the butt 10 of the corresponding needle 2 to its half position, a pair of pressers 36A and 36B as well as a presser 37 located between the pressers 36A and 36B which act upon the select jack butt 11 at its tuck position to sink the same, and a presser 38 which acts upon the select jack butt 11 at its welt position and has a greater width than the raising cam 24.

Subsequently, structure of the knitting cams 26 will be described. The knitting cams 26A and 26B are disposed symmetrically in an opposing relationship to the raising cam faces 24*a* and 24*b* of the raising cam 24 for up and down sliding movement on the cam plate 21.

In the following, description will be given of the knitting cam 26B. The knitting cam 26B has a face opposing to the raising cam face 24*b* of the raising cam 24 which serves as a loop forming lowering cam face 26*b*. According to the present invention, the knitting cams 26A and 26B are mounted on the cam plate 21 being slidable along the transfer guide cam 25. The knitting cam 26B, for example, is formed to have recessed portion 41 having a half height of the height between the surface of the knitting cam plate 21 and the upper face of the knitting cam 26B. An inclined face 42 extends from a portion located a little inwardly of the loop forming lower cam face 26*b* toward the recessed portion 41. Meanwhile, at a lower end portion of the knitting cam 26B contiguous to the lowering cam face 26*a*, a stepped portion 43 of a height with which the butt at its half position can pass therethrough is formed such that a needle having a butt of a height to a half position can be lowered only to the stepped portion but another needle having a butt of a height to a full position can be lowered to a lowermost end portion 44 so that a knit fabric can be produced which has a variation in density. Further, an extension 45 which extends into the recessed portion 41 of the knitting cam 26B is provided on the guide cam 34. The extension 45 has a lowering cam face 45*a* on one side thereof, and the transfer receiving needle lowering cam face 45*a* extends in parallel to the loop forming lowering cam face 26*a* of the knitting cam 26B. Reference numeral 46 denotes a guide cam. Since stitch increasing in the method of the present invention is somewhat coincident with a transfer step, description will be first given of transfer.

Figure 3:
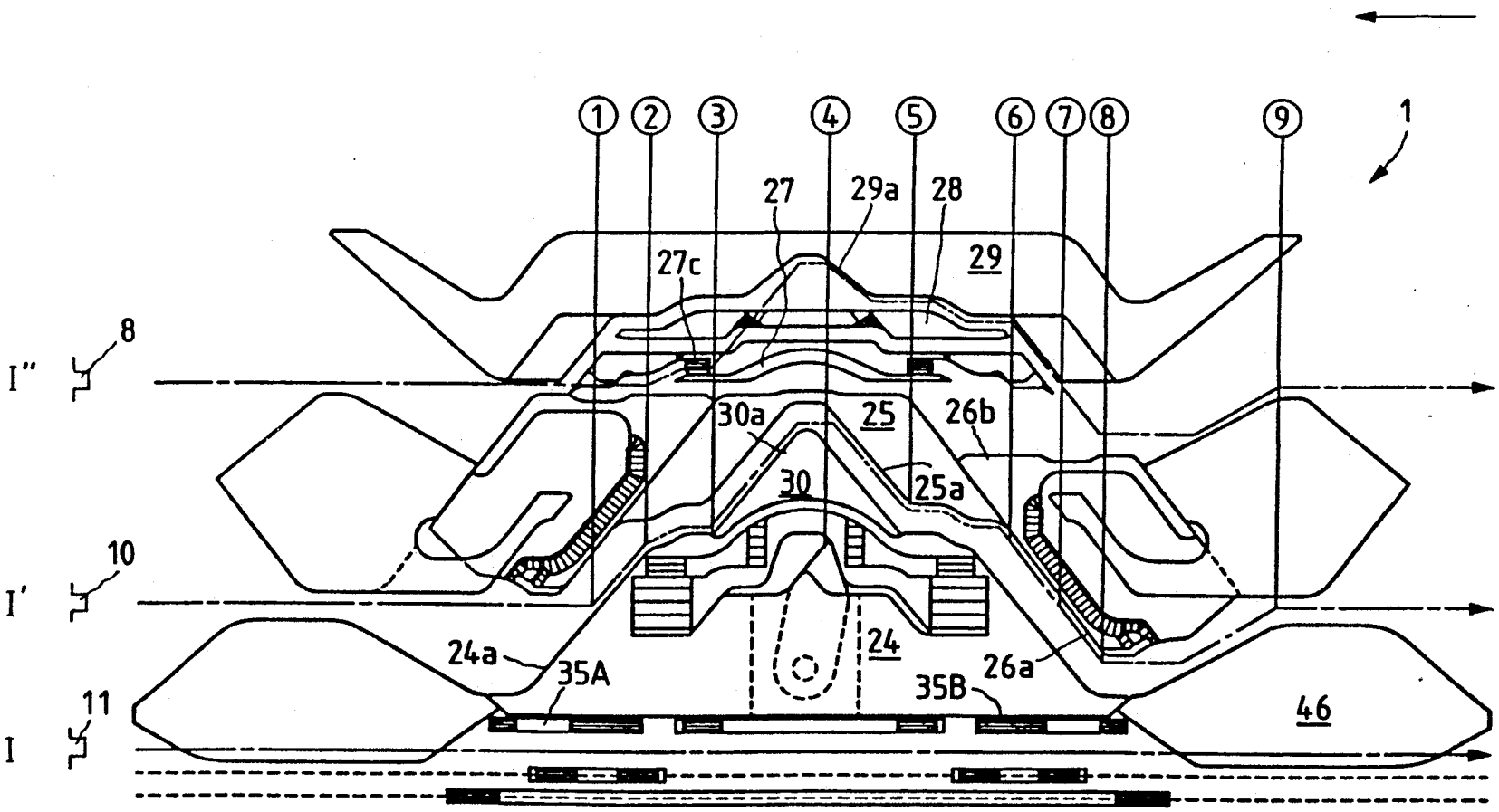
Figure 4:
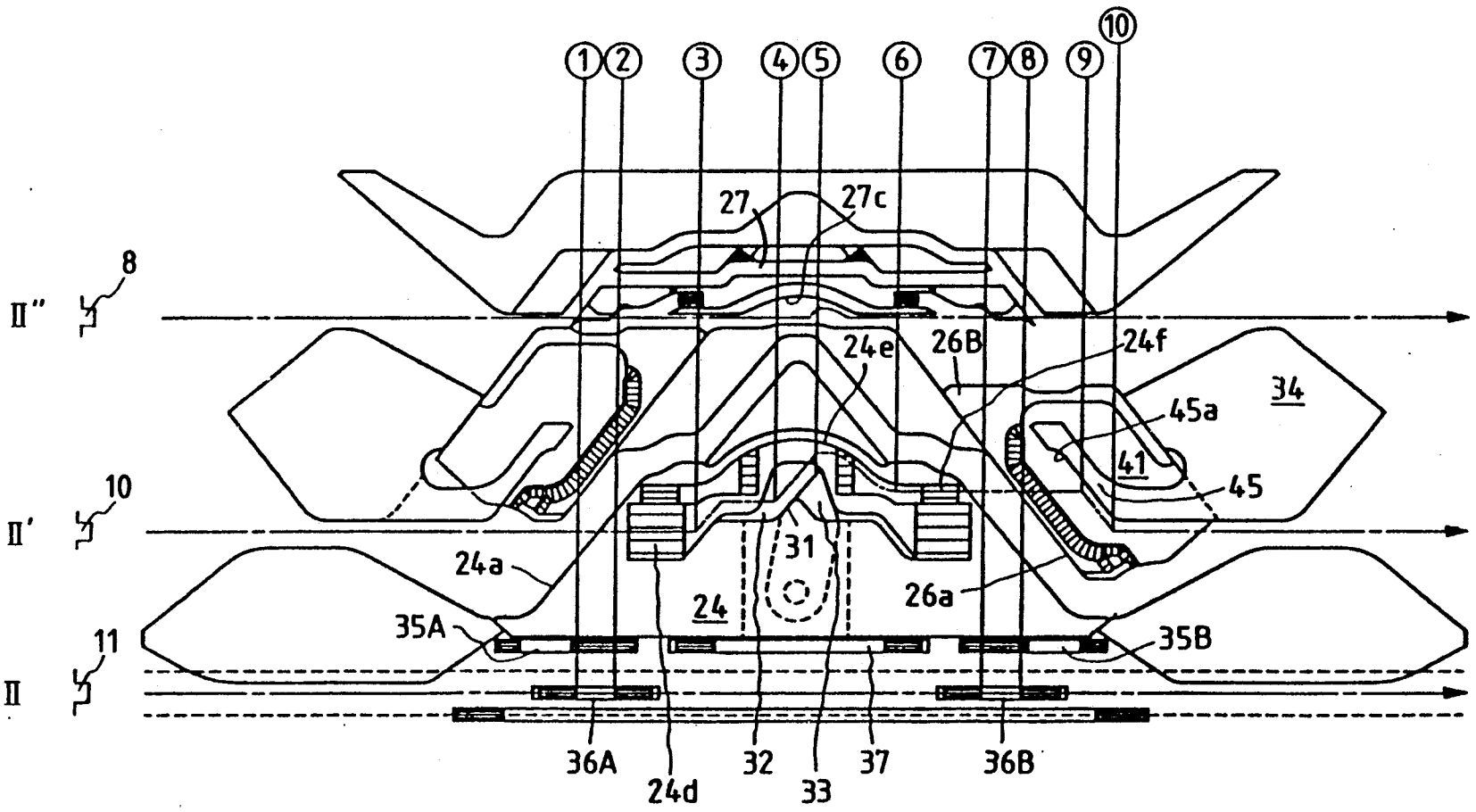

FIG. 3 shows a cam lock 1 for raising and lowering a needle on the side which is to deliver a loop while FIG. 4 shows another cam lock 1 for raising and lowering a needle on the other side which is to receive a stitch. Selection of the knit, tuck and welt positions of the needles upon transfer is performed by a conventionally known means.

First, raising and lowering movements of a needle on the side which is to deliver a loop will be described with reference to FIG. 3.

The pressers 35A and 35B are rocked to their position indicated by solid lines so that they are not engaged with the select jack butts 11 and consequently the needle butts 10 normally keep their full height. Then, the loop delivering raising cam 30 is positioned at its projected position. Here, if the carriage is moved in the direction indicated by an arrow mark in FIG. 3, then the needle butt 10 of a needle to deliver a loop moves as indicated by an alternate long and short dash line at the position I', and consequently, it is engaged with the raising cam face 24*a* of the raising cam 24 and starts its rising motion along the cam face 24*a* ((1) and (2) in FIG. 3). Meanwhile, the corresponding slider butt 8 moves as indicated by a line I'' in FIG. 3, and when the slider butt 8 comes almost to a position below a left end of the lower slider guide cam 27, an end of the slider 7 is spaced away from the hook 9 due to a difference in raising amount between the needle body 6 and the slider 7 to start opening of the hook 9, and then the hook 9 is opened fully at the position (2) in FIG. 3. While the condition is maintained, the needle butt 10 is raised along the raising cam face 24*a* of the raising cam 24 until it comes to a base portion of the loop delivering raising cam 30 ((3) in FIG. 3), whereafter it is raised along the guide face 30*a* of the loop delivering raising cam 30. Meanwhile, the slider butt 8 passes, as the needle body is raised, the raising inclined face 27*c* of the lower slider guide cam 27 ((3) in FIG. 3) and then passes the portions 28*a* and 28*b* of the middle slider cam 28 until it comes to its most raised position, whereafter it moves in a lateral direction. In the meantime, a needle on the loop receiving side which will be hereinafter described is moved to its most raised position ((4) in FIG. 3) so that it is inserted into a loop carried on the loop delivering side needle. Subsequently, the needle butt 10 and the slider butt 8 which have moved in a lateral direction are lowered respectively by the lowering guide face 25*a* of the transfer guide cam 25 and the guide face 29*a* of the upper slider guide cam 29, but in a portion while the needle butt 10 is lowered along a straight portion of the lowering guide face 25*a* of the transfer guide cam 25, the slider butt 8 moves in a lateral direction between the middle slider guide 28 and the upper slider guide cam 29, and in that portion, the slider is not lowered while only the needle body is lowered so that the hook is closed ((5)) in FIG. 3). The thus closed hook thereafter maintains its closed condition following the motion of the needle body ((6) and (7) in FIG. 3), and the needle butt is lowered by the lowering cam face 26*a* of the knitting cam 26B to a lowermost position of the cam 26B ((8) in FIG. 3), whereafter it is guided by the guide cam 46 ((9) in FIG. 3).

On the other hand, on the loop receiving side, the pressers 35A, 35B and 37 are rocked to the full line positions shown in FIG. 4 so that they may not be engaged with a select jack butt 11 for which the II position is selected. Then, the loop receiving needle raising cam 33 is positioned at a position rocked in a direction opposite to the advancing direction of the carriage, that is, rocked in the clockwise direction since it is described that the carriage advances in the direction indicated by an arrow mark in FIG. 4.

As the carriage moves in the direction of the arrow mark in FIG. 4, the select jack butt 11 advances as indicated by an alternate long and short dash line at the position II and is engaged with the presser 36A ((1) in FIG. 4). While the select jack butt 11 is held engaged with the presser 36A (between (1) and (2) in FIG. 4), it forces the needle butt 10 and the slider butt 8 to move to their full positions. Since the needle butt 10 having moved at the position II' in FIG. 4 is forced to move to the full position by the presser 36A immediately before it is engaged with the cam face 24*a* of the needle raising cam 24 ((1) in FIG. 4), it advances straightforwardly without engaging with the cam face 24*a*, and after it is released from the presser 36A ((2) in FIG. 4), it enters the recessed portion 32 from a sinking inclined face 24*d* of the needle raising cam 24 ((3) in FIG. 4), whereafter it is engaged, by way of the mountain-shaped cam face 31, with the stitch receiving needle raising cam 33 and is raised to its most raised position ((3), (4) and (5) in FIG. 4). Meanwhile, as the needle butt 10 starts its rising movement ((3) in FIG. 4), the slider begins to open, and it is opened fully at a position immediately before the most raised position of the needle butt 10, whereafter the slider is raised a little together with the needle body (after (5) in FIG. 4) while the needle butt 10 is lowered by the inner side cam face 24*e* of the needle raising cam 24 and the slider butt is lowered by the lower slider guide cam 27*e*. However, since the lowering amount of the needle butt 10 is greater than the lowering amount of the slider butt, the slider cannot be lowered with respect to the needle body and the hook of the needle remains in an open condition ((6) in FIG. 4). Then, the needle butt 10 advances straightforwardly and rises from the recessed portion 32 along the inclined face 24*f* so that it is spaced away from the needle raising cam 24. However, since the select jack butt 11 undergoes an action of the presser 36B (between (7) and (8) in FIG. 4), it assumes its fully sunk position again and thus jumps the lowering inclined face 26*a* of the knitting cam 26B without engaging with the same. Then, in the recessed portion 41 of the knitting cam 26B, it is projected again, and consequently, it is engaged with the extension 45 of the guide cam 34 ((9) of FIG. 4) and retracted by the guide face 45*a*, and consequently, the hook is closed. After then, the needle butt advances together with the slider butt while the hook is closed.

Figure 5:
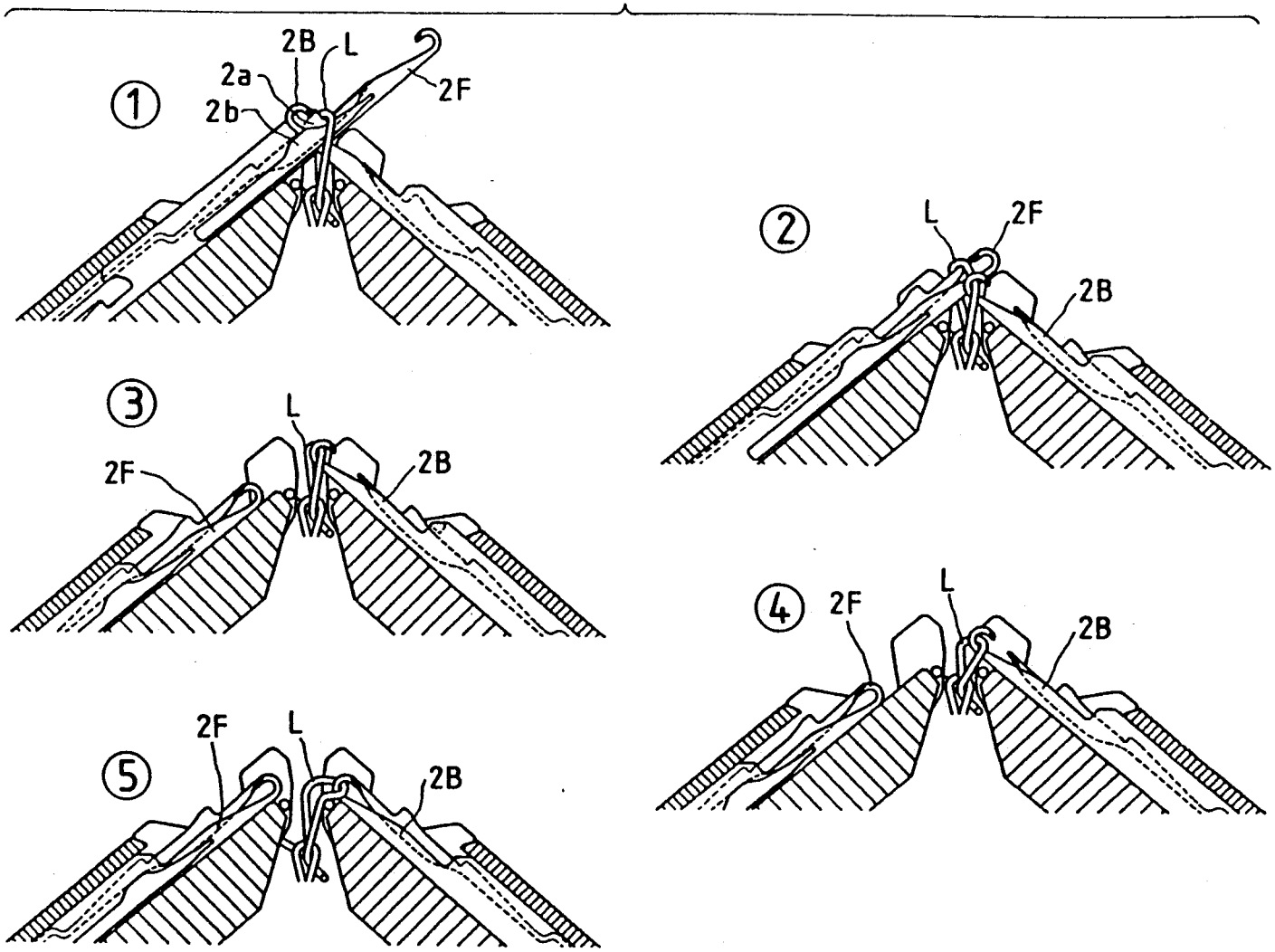

While the needle on the loop delivering side and the needle on the loop receiving side are operated by the separate cam locks on the loop delivering side and the loop receiving side, respectively, as described above, conditions of such delivery and reception of a thread are shown in FIG. 5.

Describing in an order, the needle 2F on the loop delivering side is raised to its most raised position as shown in (1) of FIG. 5 so that a loop L to be transferred is caught by a stepped portion 2*a* provided on the shank of the needle 2F. In this instance, a spring blade 2*b* of the needle from which the loop is to be transferred is inserted into the loop L. The position of the needle 2F is the position of (4) shown in FIG. 3. There, the receiving needle 2B is raised between the spring blade 2*b* and the needle 2*f* to insert the hook thereof into the loop L to be transferred. The position of the needle 2B is (5) shown in FIG. 4. In this instance, the hooks of both of the needles are open.

Subsequently, the needle 2F on the loop delivering side is lowered as seen in (2) of FIG. 5. However, the lowering amount of the slider is smaller compared to the lowering amount of the needle body, and consequently, the slider has such a form as to rise with respect to the needle body so that the hook is closed. The position of the needle 2F then is shown at 5 in FIG. 3. Then, the needle 2B on the loop receiving side is lowered a little so that it arrests the loop L with the open hook thereof. The position of the needle 2B then is shown at 6 in FIG. 4.

The loop delivering side needle 2F is further lowered relative to the loop receiving side needle 2B which maintains the position described above for a while so that it is spaced away from the loop L as seen in of FIG. 5 at 3. This position is shown in FIG. 3 at 7 and in FIG. 4 at 8.

Subsequently, the needle 2B on the loop receiving side starts its lowering movement as seen in of FIG. 5 at 4. The position is shown in FIG. 4 at 9. The hook is closed at the position shown in FIG. 4 at 10 when such lowering movement is completed.

Then, the needle 2F on the loop delivering side is raised with the hook held closed as seen in FIG. 5 at 5 in order to prepare for subsequent starting of knitting. The position of the needle 2F is shown in FIG. 3 at 8.

Subsequently, a basic form of loop increasing according to a stitch increasing knitting method of the present invention will be described.

Figure 6:
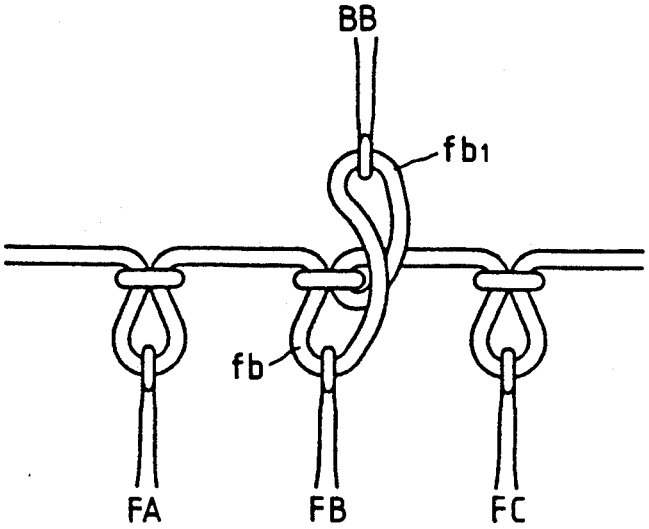
Figure 7:
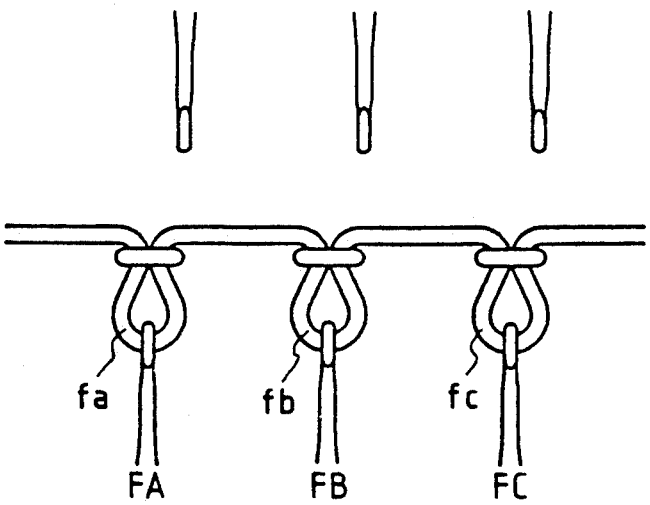

In the case of stitch increasing according to the method of the present invention, such a loop as shown in FIG. 6 is produced, and several variations are developed based on the loop. In particular, while there are left stitch increasing, right stitch increasing, cast-on stitch increasing and so forth, an example will be described subsequently wherein, when knitting is performed while loops fa, fb, fc, . . . are carried on needles FA, FB, FC, . . . of one of a pair of needle beds provided in an opposing relationship as shown in FIG. 7, for example, on the front side needle bed, the loop fb on the needle FB is increased to make loops fb and fb1.

In stitch increasing of the present invention, as apparent also from FIG. 6, part of the loop fb carried on the needle FB on one of the needle beds provided in pair is delivered as a new loop fb1 to another needle BB on the opposing needle bed. While, in conventional transfer, the loop delivered to the needle BB is removed from the needle FB on which the loop has been carried, according to the method of the present invention, the loop on the needle FB is partially delivered to the opposing needle BB without being removed from the needle FB.

Figures 8A, 8B:
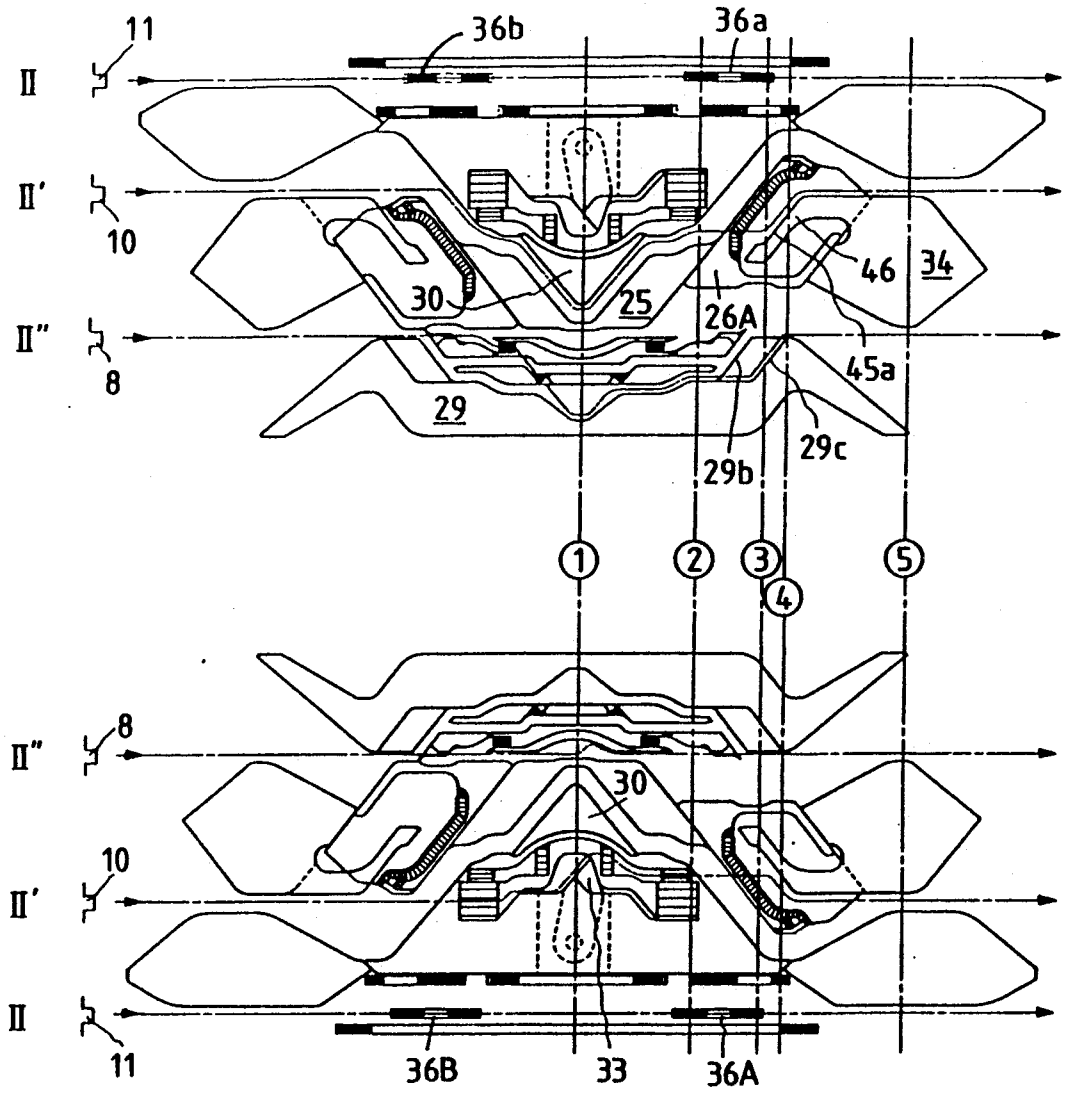
FIG. 8*a* and FIG. 8*b* are bottom plan views of the cam lock showing loci of needles on the delivering side and receiving side when the present invention is embodied. ① to ⑤ of FIG. 9 are side elevational views of needles illustrating a knitting procedure upon increasing of a stitch.

Delivery and reception of a loop will be described with reference to cam locks shown in FIG. 8*a* and FIG. 8*b*. This is an example wherein a stitch is increased from the cam lock shown at an upper portion in FIG. 8 to the other cam lock shown at a lower portion in FIG. 8. In the example described above, the side which is to deliver a loop therefrom will be hereinafter referred to as the delivering side while the side which is to receive such loop will be hereinafter referred to as the receiving side. The cam lock shown in FIG. 8*a* is the delivering side and the other cam lock shown in FIG. 8*b* is the receiving side. On the receiving side, the pressers 36A and 36B, loop delivering raising cam 30 and so forth assume the same positions as those upon transfer. On the delivering side, the trailing side presser 36*a* and loop delivering raising cam 30 are positioned to respective operative positions while the leading side presser 36*b* is positioned to its inoperative position. The carriage advances in the direction indicated by an arrow mark, and select jack butts 11, needle butts 10 and slider butts 8 follow the courses of alternate long and short dash lines indicated by II, II' and II", respectively.

Figure 9:
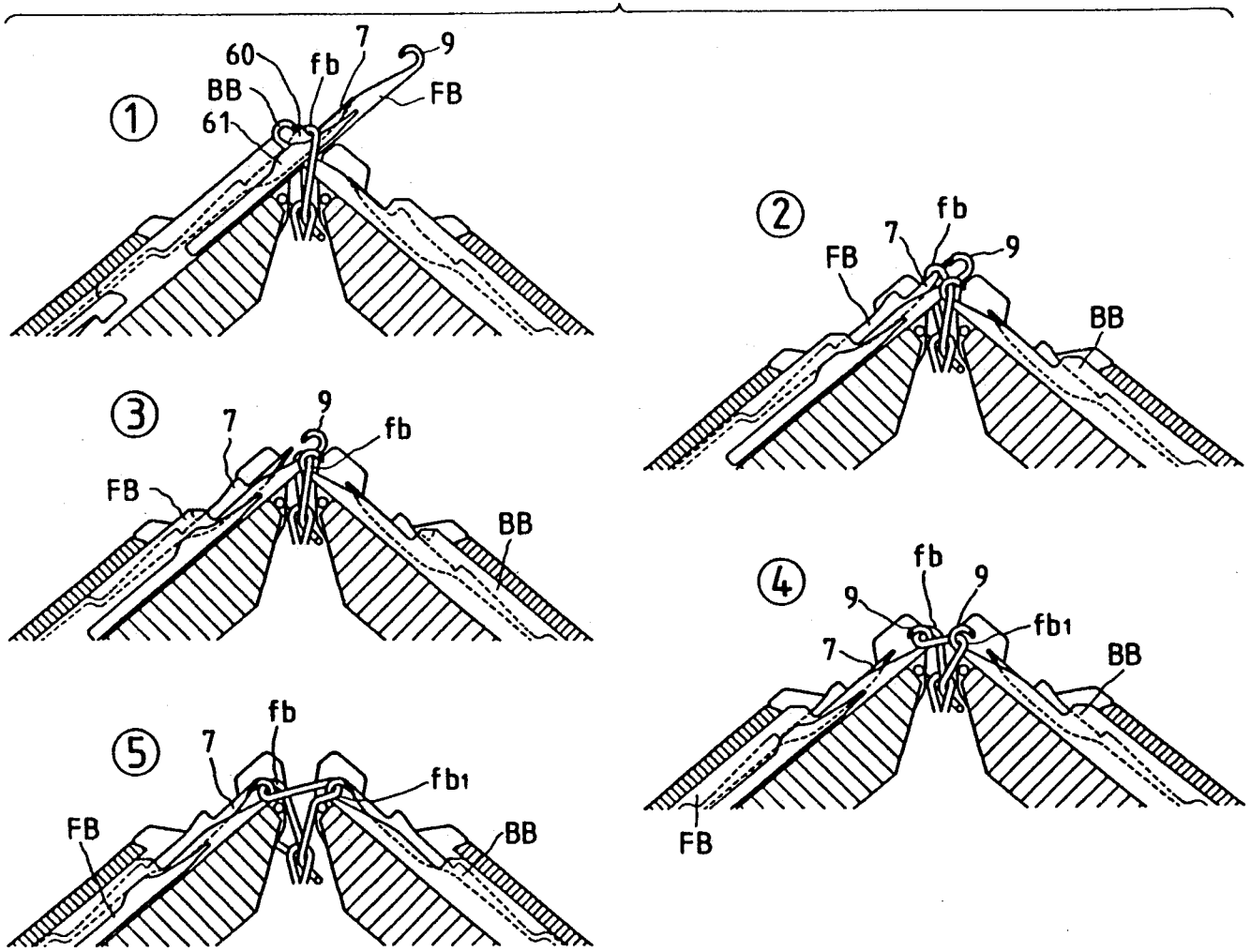

First, the body of the needle FB on the delivering side having the loop fb thereon is raised by the course of II'. In this instance, since the raising amount of the slider butt 8 is smaller compared to the raising amount of the needle butt 10, the slider lowers and the hook is opened as the needle body is raised. Consequently, the loop fb carried in the hook slips in the hook and is arrested by a stepped portion 60 of the needle FB. Thereupon, the needle BB on the receiving side opposing to the needle FB is raised by the loop receiving needle raising cam 33 similarly as upon transfer so that the hook 9 is inserted between the blade 61 and the needle FB, thereby to insert the hook 9 into the loop fb (the position of 1 shown in FIG. 8 and 1 of FIG. 9). Subsequently, the needle FB on the delivering side is lowered by the transfer guide cam 25, but since the slider passes between the middle slider guide 28 and the upper slider guide 29, the lowering amount thereof is small and consequently, the slider 7 of the needle FB is put into a closing condition with respect to the hook 9 and part of the loop fb is caught by the hook 9 of the needle BB on the receiving side (the position of (2) shown in FIG. 8 and (2) of FIG. 9). By succeeding movement of the carriage, the select jack butt 11 of the needle FB on the delivering side is engaged with and sunk by the presser 36A. Consequently, the needle butt 10 is pushed into the needle trick and thus jumps the cam face of the knitting cam 26A and enters the recessed portion 41, and then it is engaged with the lowering cam face 45*a* of the extension 45 of the guide cam 34. Since the slider butt 8 is simultaneously sunk it is not engaged with the lowering cam face 29*b* of the upper slider guide cam 29, and as the select jack butt 11 is disengaged from the presser 36A and the slider butt 8 comes out of the needle trick and is thus engaged with the lowering cam face 29*c*, the slider is lowered and the hook is opened, and the loop fb is arrested by the hook 9 of the needle FB (the position of (3) shown in FIG. 8 and (3) of FIG. 9), whereafter both of the needles FB and BB are lowered further. As a result, the loop fb, which is not carried, in normal transfer, on the needle FB at this position, remains carried on the hook of the needle FB (the position of (4) shown in FIG. 8 and (4) of FIG. 9). Then, as both of the needles FB and BB are further lowered, the loop fb carried on the hooks of both of the needles makes loops fb and fb1 (the position of (5) shown in FIG. 8 and (5) of FIG. 9).

Figure 10:
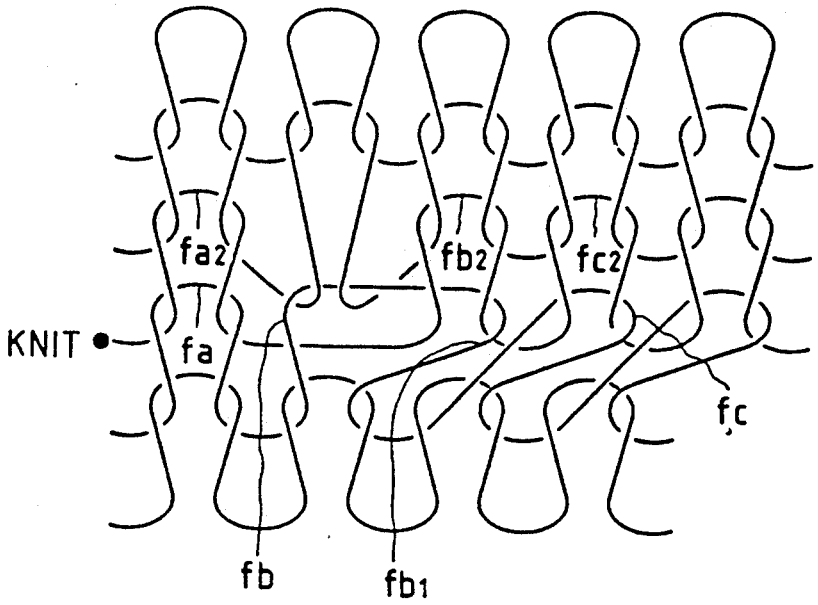

As a first example of the application of the description above, knitting in left loop increasing of a texture shown in FIG. 10 will be described. A knitting process of the texture is shown in FIG. 11.

A back bed having needles BA, BB, BC, . . . thereon is provided for a front bed having needles FA, FB, FC, . . . thereon, and left loop increasing is performed for a knit fabric carried on the needles FA, FB, . . . of the front bed.

Figure 11:
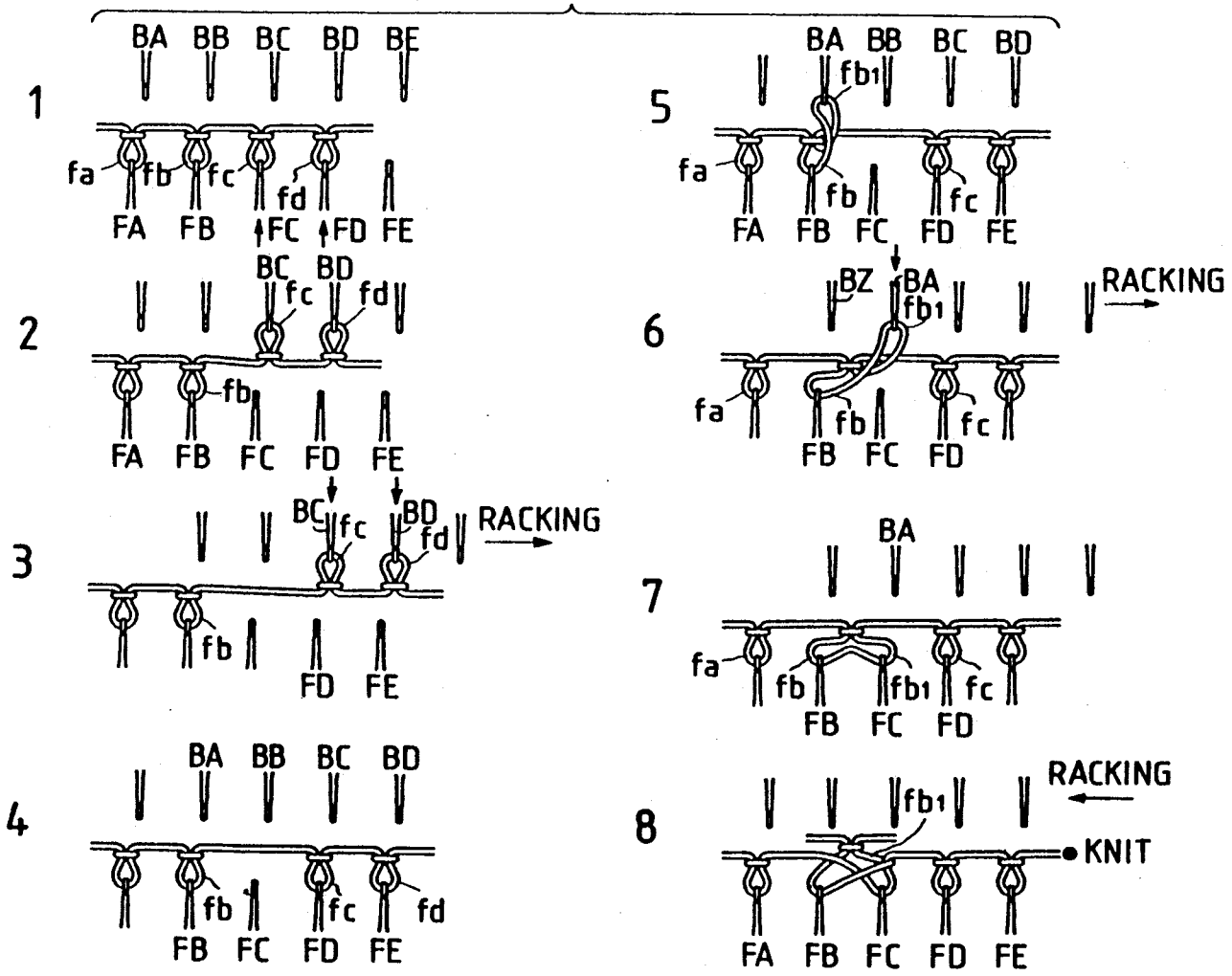

Loops fa, fb, . . . are carried on the needles FA, FB, . . . of the front bed (1 of FIG. 11). Thus, it is intended to increase a new loop fb2 between the loops fb and fc, and first the loops fc, fd, . . . are rightwardly by one loop distance to a condition shown in 4 of FIG. 11. The means is such that the loops fc, fd, . . . on the needles FC, FD, . . . of the front bed are first transferred to the needles BC, BD, . . . of the back bed (2 of FIG. 11) and then the back bed is racked rightwardly by one pitch (3 of FIG. 11), and then at the position, the loops fc and fd carried on the needles BC, BD of the back bed are transferred to the needles FD and FE of the front bed. The needle FC which does not have a loop thereon is made between the needles FB and FD of the front bed in this manner (4 of FIG. 11). Subsequently, the loop fb carried on the needle FB of the front bed is formed to have two loops and part of the loop fb is arrested by the needle BA of the back bed at a position opposing to the needle FB of the front bed on which the loop fb is carried thereby to make a loop fb1 (5 of FIG. 11). The means is the same as the means described hereinabove with reference to FIG. 9, and the shape of the loop which is carried on the needle FB of the front bed and the needle BA of the back bed has a same basic shape as that shown in FIG. 6. If the back bed is racked rightwardly by one pitch in this condition, the condition shown in 6 of FIG. 11 is obtained. Then, the loop fb1 carried on the needle BA of the back bed is transferred to the needle FC of the front bed on which no loop is carried, thereby to obtain such a condition as shown in 7 of FIG. 11. If knitting of a course is performed with the needles FA, FC, FD and FE, then such a condition as shown in 8 of FIG. 11 is obtained. After then, knitting is performed with all of the needles FA, FB, FC, . . .

Figure 12:
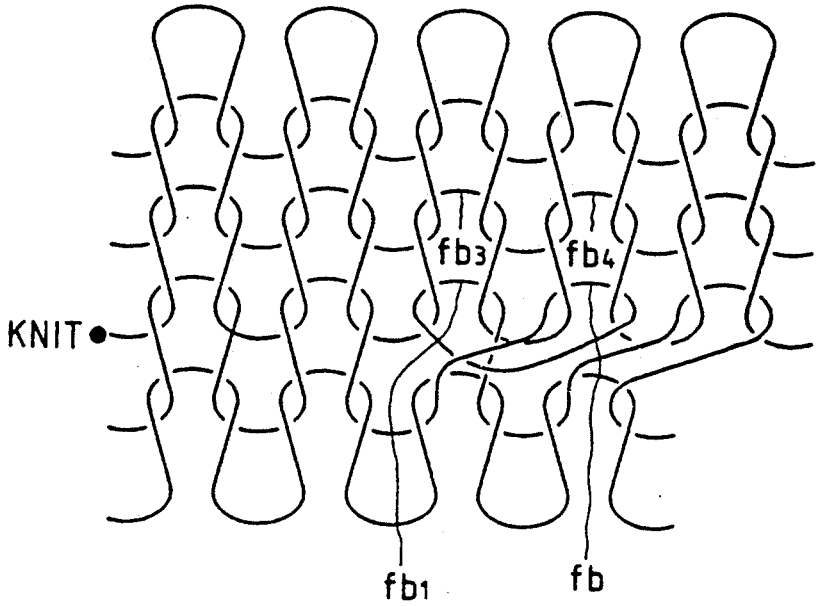

As a modification to the example of application described above, an example shown in FIG. 12 is constituted such that the direction of racking is reversed to that in the first example of application so that knitting can be performed for all wales immediately after increasing of a loop.

Figure 13:
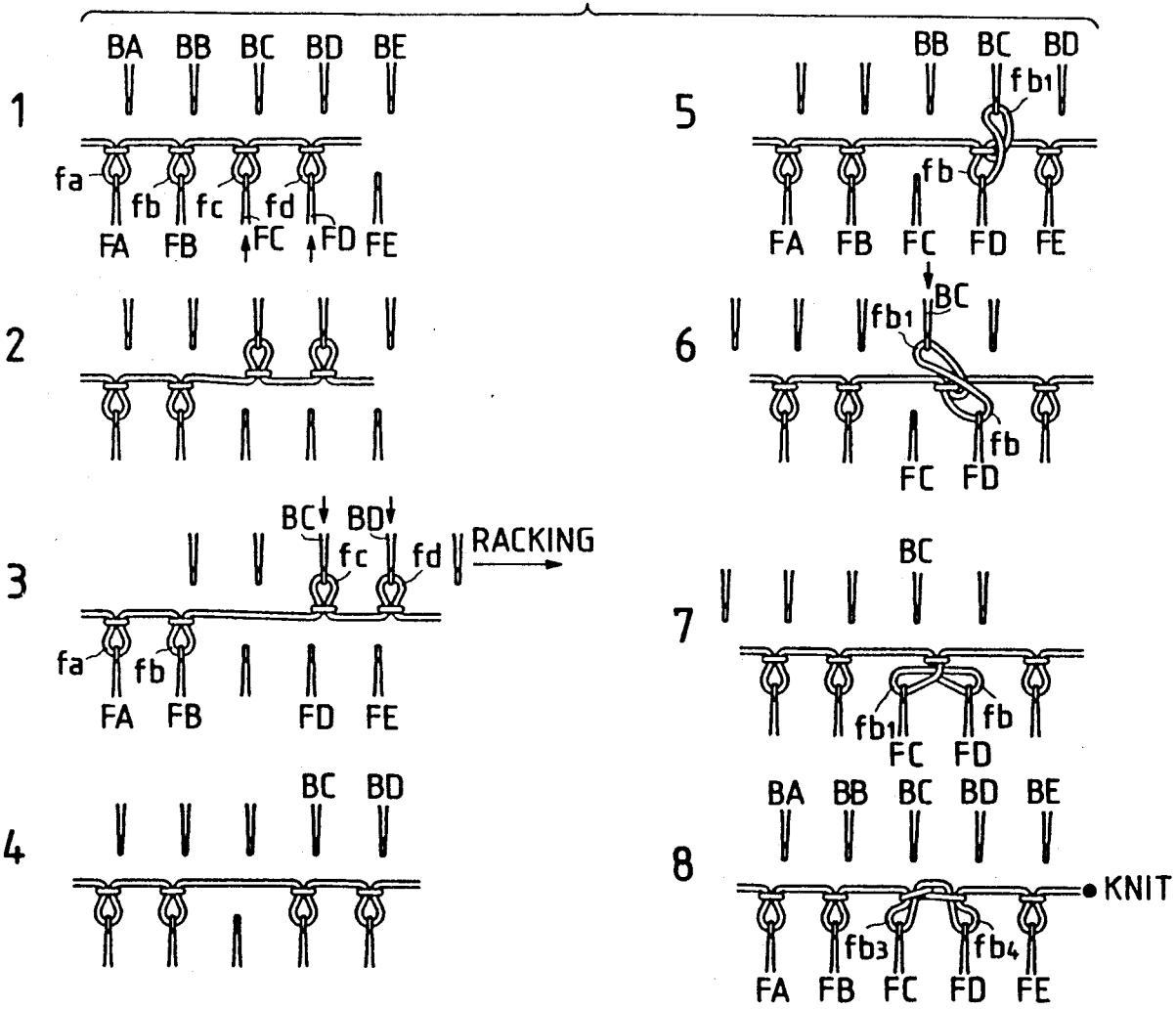

Knitting steps are illustrated in an order in FIG. 13. In the case of the present example, different from the condition shown in 5 of FIG. 11 wherein a loop is carried between the needle FB on the left-hand side of the needle FC which does not have a loop thereon and the opposing needle BA, a loop is carried between the needles FD and BC on the right-hand sides of the needles FC and BB which have no loop thereon as seen in 5 of FIG. 13. Then, the back bed is racked leftwardly by one pitch and a loop of the needle BC is transferred to the needle FC as seen in 6 and 7 of FIG. 13. Consequently, the loop carried on the needles FC and FD is closed in the present example while loop carried on the needles FB and FC shown in 8 of FIG. 11 in the example described hereinabove remains open. Accordingly, when knitting for a next course is to be performed from the condition shown in 7 of FIG. 13, knitting can be performed immediately using all of the needles.

Figure 14:
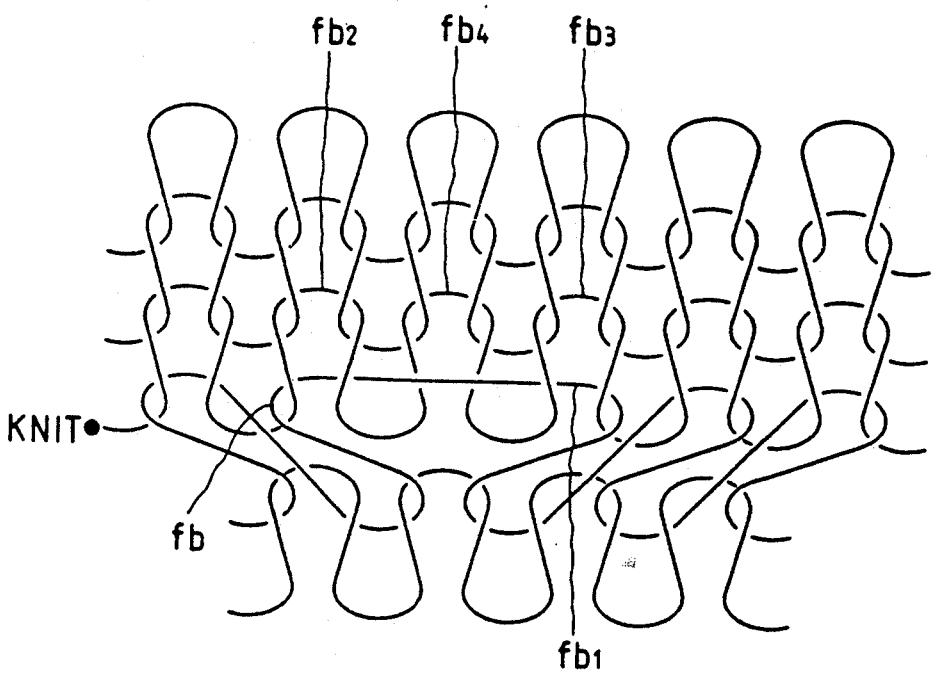
Figure 16:
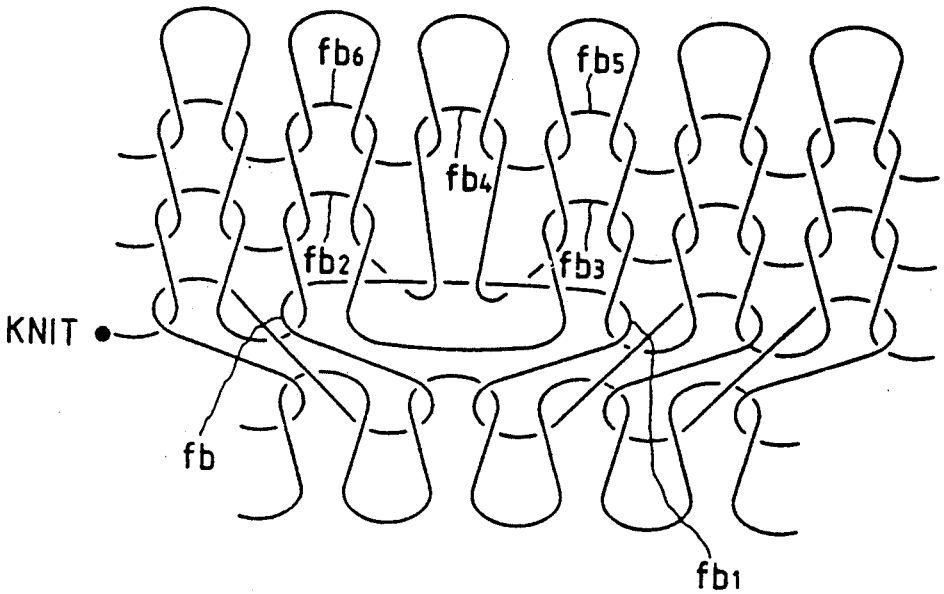
Figure 15:
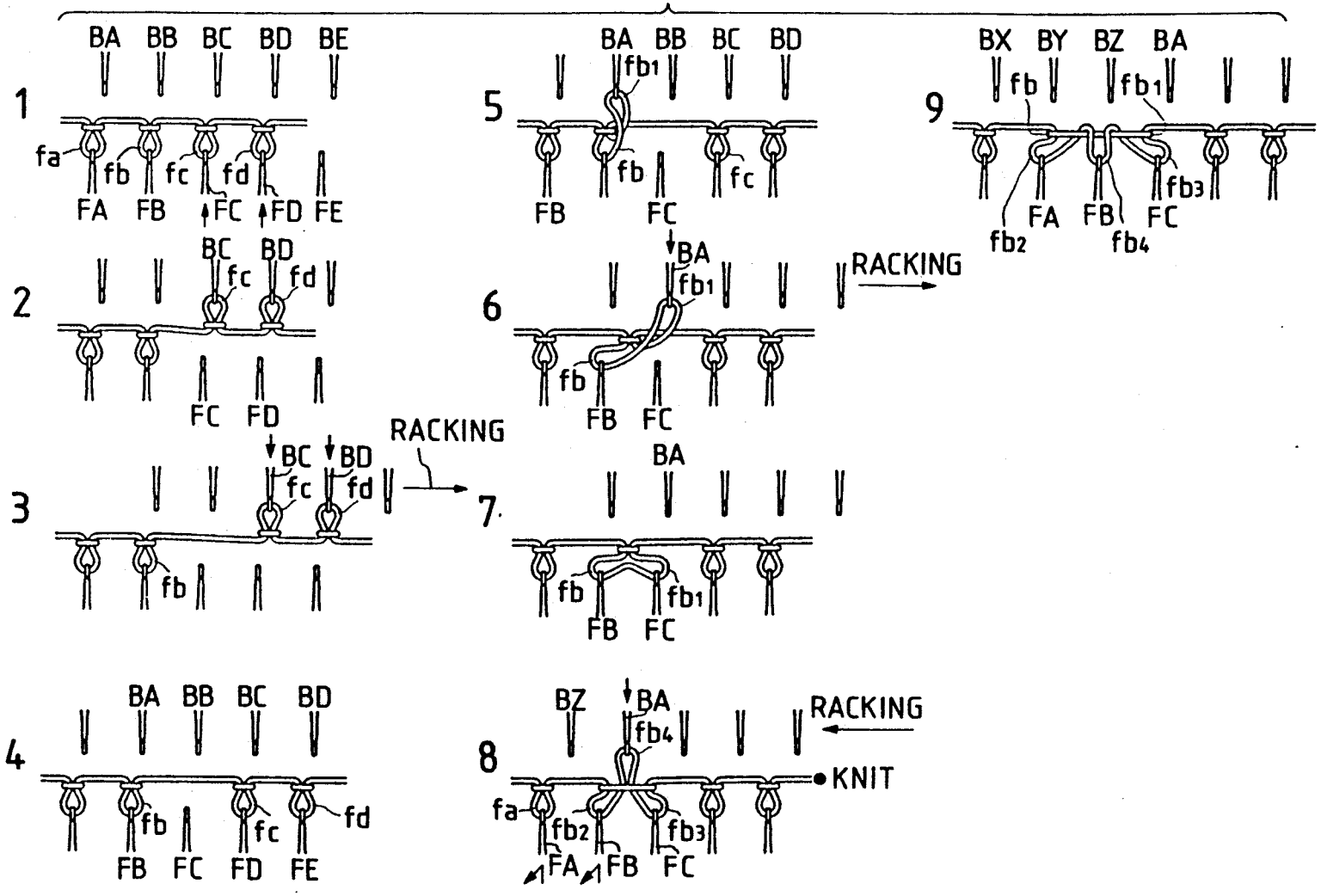
Figure 17:
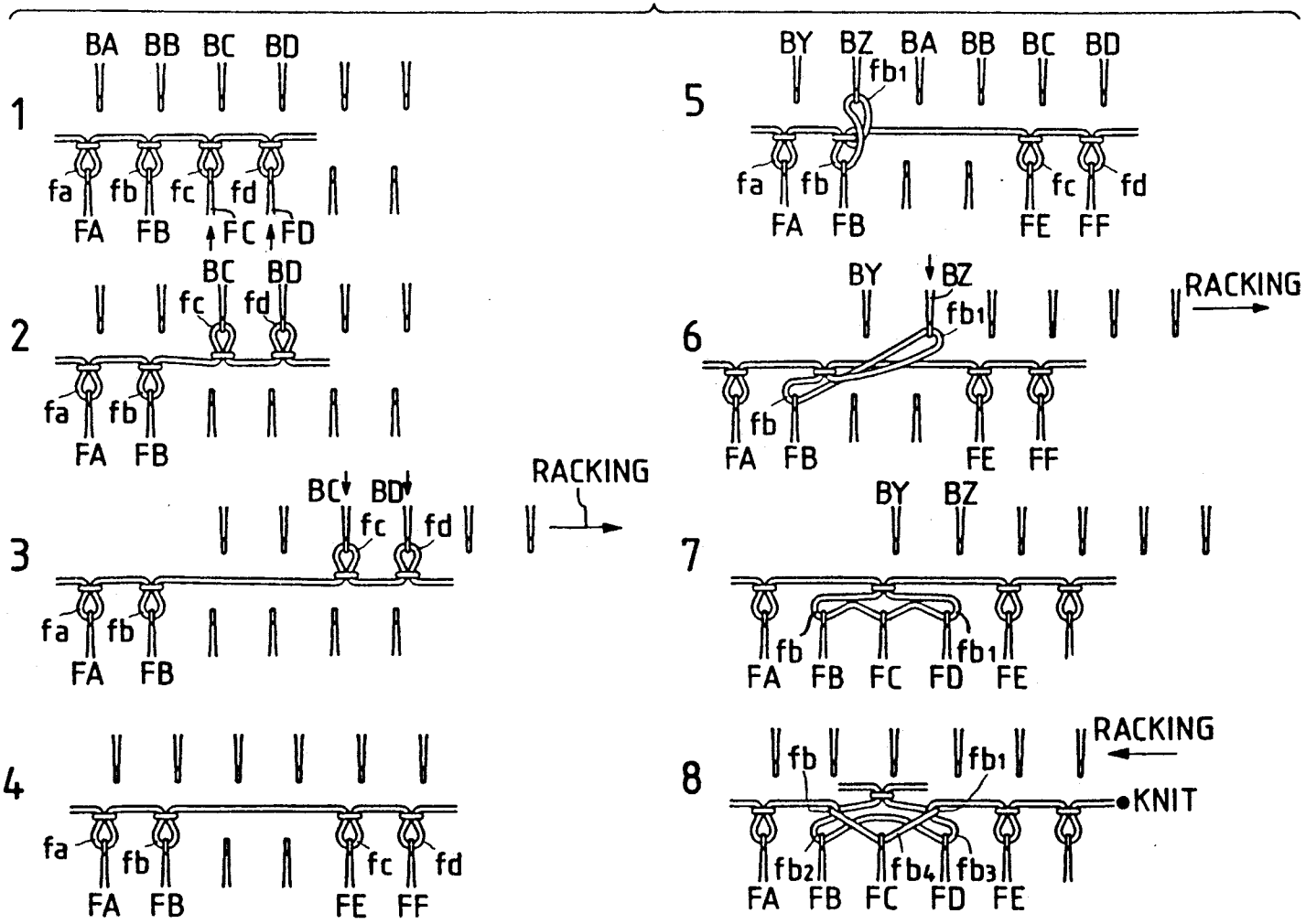
Figure 18:
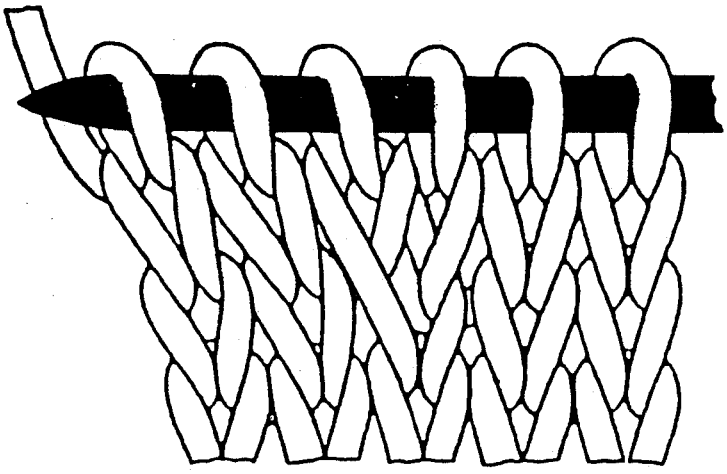
FIGS. 18 and 19 are plan views illustrating examples of loop increasing by hand knitting.
Figure 19:
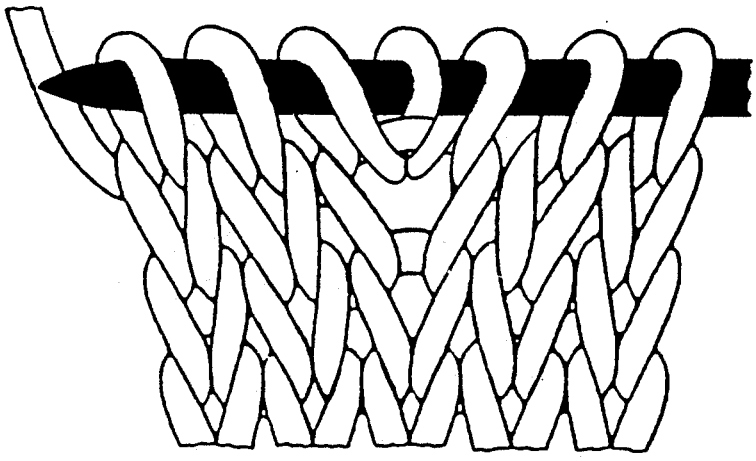

An example which makes use of cast-on loop increasing of three loops shown in FIG. 14 will be described subsequently as a second example of application. While such knitting steps are illustrated in FIG. 15, the steps to the step shown in 5 of FIG. 15 are same as those shown in FIG. 11. In 6 of FIG. 15, the back bed is racked rightwardly by one pitch to oppose the needle BA to the needle FC. Then, a loop fb1 of the needle BA is transferred to the needle FC (7 in FIG. 14). Subsequently, the back bed is racked leftwardly by a half pitch to position the needle BA in an opposing relationship between the needles FB and FC. Then, a thread is supplied to the needle BA and all of the needles FA, FB, . . . on the front bed side, and then the needles are lowered. Consequently, such a condition as shown in 8 of FIG. 15 is obtained. Thus, the front bed is racked leftwardly by a half pitch from this condition, and then loops of the needles FA and FB on the front bed are transferred to needles BY and BZ on the back bed, whereafter the back bed is racked leftwardly by one pitch and then the loops of the needles BY, BZ and BA of the back bed are transferred to the needles FZ, FA and FB of the front bed (9 of FIG. 15). Also in an example shown in FIG. 16, knitting is performed in such an order as illustrated in FIG. 17 with cast-on loop increasing of three loops. By such knitting, three cast-on increased loops are made, and by making use of such loop increasing for a case wherein a knitting width is to be increased in fashioning or the like, it is facilitated to perform fashioned knitting on an automatic knitting machine. Further, as an example of production of a pattern, a pattern which makes use of loop increasing such as, for example, Aran pattern, can be knit on an automatic machine.

As described in detail so far, according to a method of the present invention, among compound needles inserted in needle grooves of first and second needle beds disposed with ends thereof opposed to each other, the needle in either one of the first and second needle beds which has a loop carried thereon is raised to a transfer position, and then another needle in the opposing needle bed is raised until it is inserted into the loop carried on the former needle, whereafter the two needles are lowered to cause the knit fabric loop to be caught by the hook of the latter needle, and then, when the needle which has been lifted to the transfer position is lowered, the loop carried on the needle being lowered is caught again in the hook of the needle being lowered so that the loop extends between the needles in the first and second needle beds. Accordingly, stitch increasing which is possible by hand knitting but has been considered impossible with an automatic flat knitting machine is made possible. Further, by developing the basic form of such stitch increasing, it can be utilized for the case wherein a knitting width is to be increased by left stitch increasing, right stitch increasing, cast-on stitch increasing or the like as in fashioned knitting, and knitting on an automatic knitting machine is further facilitated. Also in production of a pattern, it is possible to knit, on an automatic machine, a pattern which makes use of stitch increasing such as, for example, Aran pattern.

Meanwhile, a needle operating cam for a flat knitting machine which has a loop knitting cam and a loop transfer cam for operating needle bodies and sliders of compound needles separately from each other, is constituted such that, for a lowering face of a needle body lowering cam of a loop delivering side cam of the loop transfer cam, a slider lowering face for lowering a slider at a timing earlier than that by the lowering face of the needle body lowering cam is provided. Accordingly, it is possible to perform transfer and stitch increasing with a same lock, and operation which is conventionally performed in separate two operations requires only one time of operation and consequently the knitting efficiency can be improved.

Next, other embodiments according to the present invention will be described, a second embodiment relates to a needle operating cam having a lock for increasing a stitch a, third embodiment relates to one having a knitting lock and a lock for increasing stitch, and a fourth embodiment relates to one having a transfer lock and a lock for increasing stitch.

Figure 20:
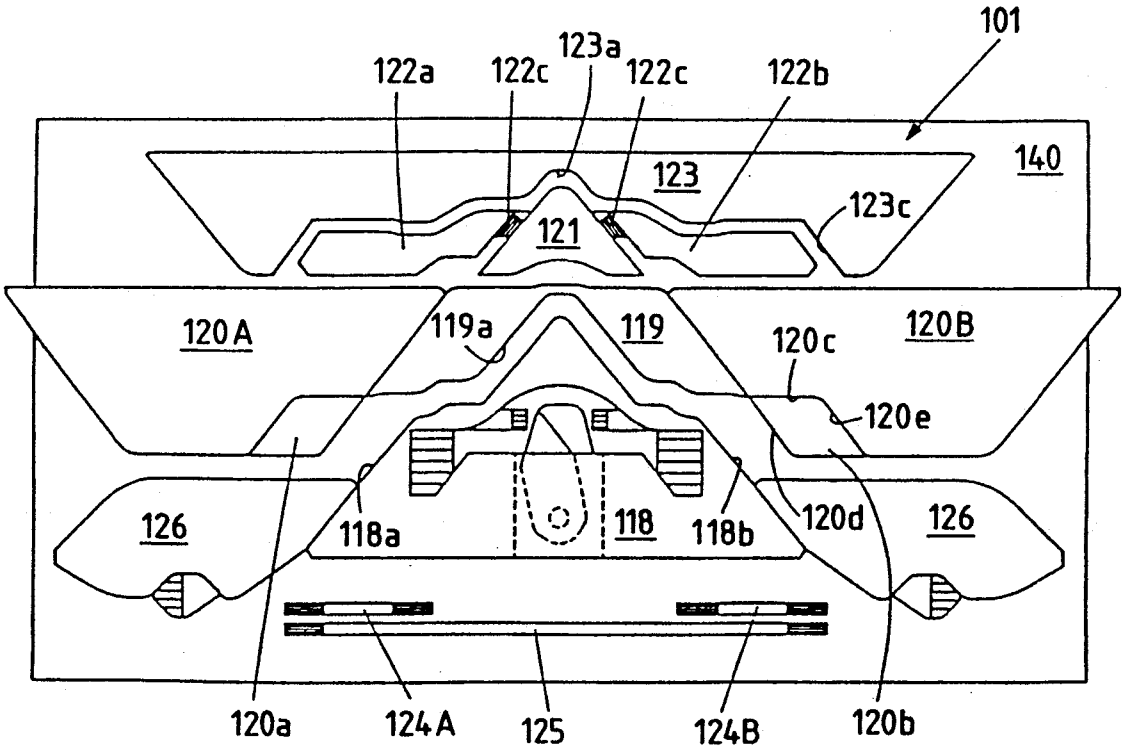
FIG. 20 is a plan view showing a cam lock of a carriage according to a second embodiment as viewed from below.
Figure 21:
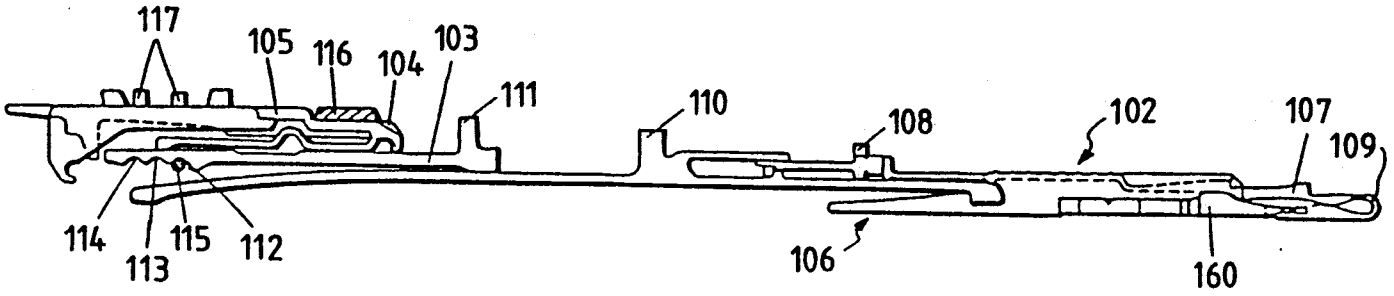
FIG. 21 is a side elevational view of a compound needle.

FIG. 20 shows a condition of a cam lock 1 of a carriage of a second embodiment according to the present invention as viewed from below, and FIG. 21 shows a side elevation of a needle 102, a select jack 103, a selector 104, a select jack presser 105 and so forth.

Meanwhile, the needle 102 used in a flat knitting machine equipped with a needle operating cam according to the present invention is a compound needle, and a slider 107 is slidably fitted at an upper portion of an end of a needle body 106 such that a hook 109 of the needle body 106 may be opened or closed by the slider 107 by operating a slider butt 108.

Reference numeral 110 denotes a needle butt provided on the needle body 106. A select jack butt 111 has recesses 112, 113 and 114 provided at a base portion thereof such that they may be selectively engaged with a wire 115 extending through a needle bed (not shown) to define a position of the select jack butt 111. When the wire 115 is engaged with the recess 112, the select jack butt 111 is positioned at its welt position; when the wire 115 is engaged with the recess 113, the select jack butt 111 is positioned at its tuck position; and when the wire 115 is engaged with the recess 114, the select jack butt 111 is positioned at its knit position.

The select jack presser 105 is a resilient plate member having a channel-shape side elevation and is engaged at an upper edge thereof with a band plate 116 inserted in and extending through the needle bed (not shown) to press at an end portion thereof against the select jack 103 to urge the select jack butt 111 in a direction to move upwardly. Reference numeral 117 denotes a selector butt of the selector 104.

In the following, description will first be given of constructions of the second embodiment, third embodiment and fourth embodiment of a needle operating cam for a flat knitting machine according to the present invention. It is to be noted that, while the needle operating cams for flat knitting machines shown in the second embodiment and third embodiment (refer to FIGS. 20 and 22) do not have a transfer function, the word "transfer" will be used for convenience in the description given below. Further, while the needle operating cams shown in the second embodiment and fourth embodiment (refer to FIGS. 20 and 23) do not have a knitting function, the words "knot position, tuck position" will be used for convenience in the description given below. Further, while the needle operating cams for a flat knitting machine of the individual embodiments have different constructions and functions, common words and reference numerals are used for various components for convenience.

Thus, the needle operating cam for a flat knitting machine of the second embodiment according to the present invention shown in FIG. 20 described above is provided for the exclusive use for the knitting of an increased loop, and a cam lock 101 provided on a cam plate 140 includes a needle raising cam 118 having a trapezoidal shape wherein the opposite side inclined faces serve as raising cam faces 118*a* and 118*b*, a trapezoidal guide cam 119 disposed on the same center line as the needle raising cam 118 and having a mountain-shaped concave cam face 119*a*, a pair of fixed guide cams 120A and 120B provided on the opposite sides of the guide cam 119 and needle raising cam 118, and a middle guide cam 121, a pair of slider guide cams 122*a* and 122*b* and an upper slider guide cam 123 provided above the guide cam 119.

Each of the fixed guide cams 120A and 120B has a lowering guide face portion 120*a* on the inner side of a lower portion thereof, and the lowering guide face portions 120*a* and 120*b* have a half height of a parallelogram shape while guide faces of the lowering guide faces 120*a* and 120*b* for a needle butt 110 are each composed of an upper horizontal guide face 120*c* and a pair of inclined guide faces 120*d* and 120*e*.

The middle guide cam 121 is located above the guide cam 119 and has a substantially triangular shape, and the slider guide cams 122*a* and 122*b* are provided on the opposite sides of the middle guide cam 121. An inclined face 122*c* for guiding a slider butt 108 is formed at each of the portions of the middle guide cam 121 which are engaged with the slider guide cams 122*a* and 122*b*.

The upper slider guide cam 123 is located above the slider guide cams 122*a* and 122*b* and the middle guide cam 121 and has a guide face 123*a* formed to define a mountain-shaped recessed portion at a mid portion thereof, and the opposite ends of the upper slider guide cam 123 fall in such a configuration that they cover over the opposite sides of the middle guide cam 121 and slider guide cams 122*a* and 122*b* such that a pair of loop increasing lowering guide faces 123*c* are provided thereon. The loop increasing lowering guide faces 123*c* have a full height.

Located below the needle raising cam 118 are a pair of pressers 124A and 124B which act upon the select jack butt 111 at its tuck position to sink the same, and another presser 125 which acts upon the select jack butt 111 at its welt position and has a greater width than the needle raising cam 118. Reference numeral 126 denotes a guide cam.

Figure 22:
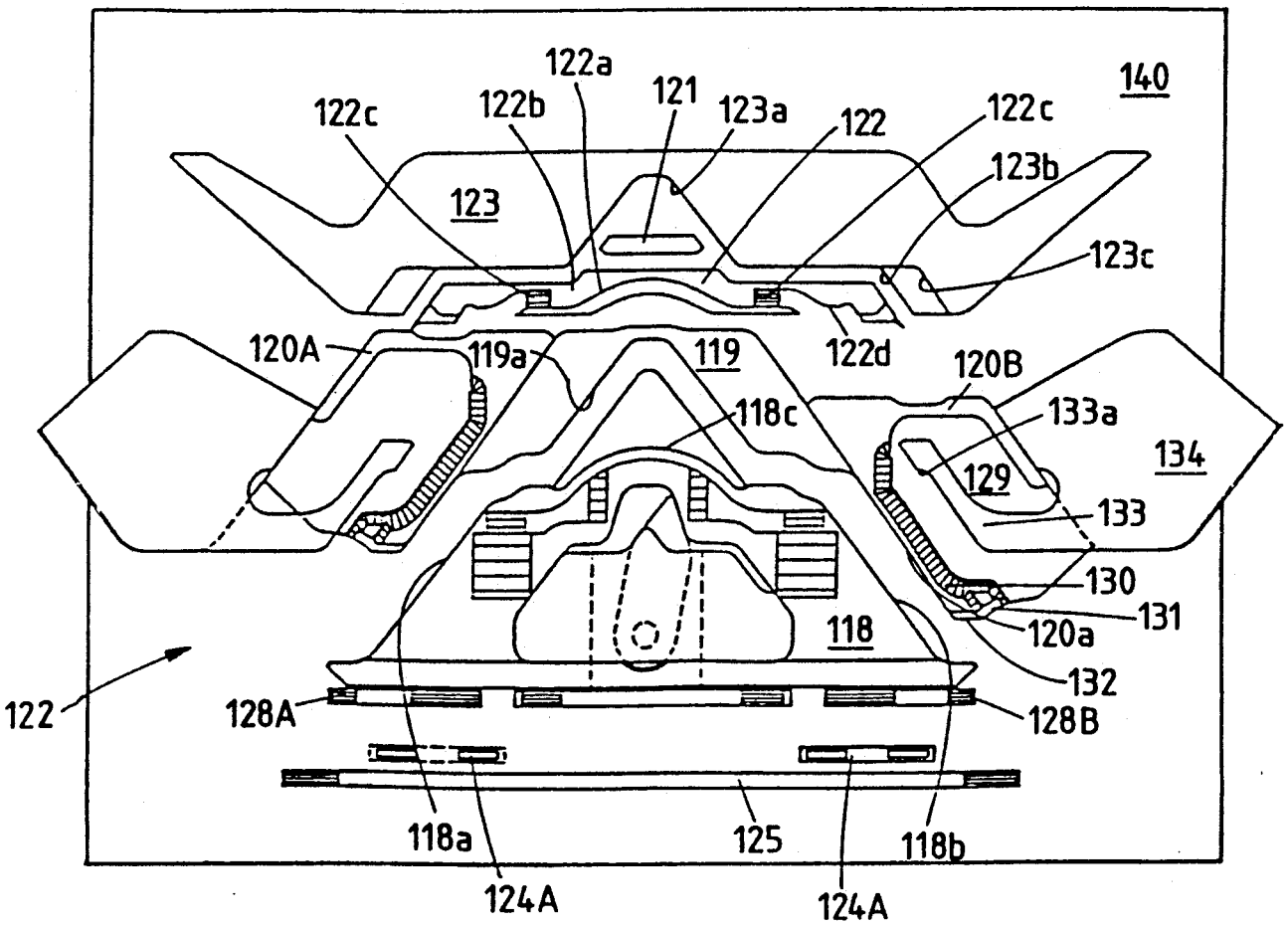
FIG. 22 is a plan view showing a cam lock of a carriage according to a third embodiment as viewed from below.

The needle operating cam for a flat knitting machine of the third embodiment according to the present invention shown in FIG. 22 has both a knitting function and an increased stitch knitting function, and a cam lock 122 provided on a cam plate 140 includes a needle raising cam 118 having a trapezoidal shape wherein the opposite side inclined faces serve as raising cam faces 118*a* and 118*b*, a trapezoidal transfer guide cam 119 disposed on the same center line as the needle raising cam 118 and having a mountain-shaped concave cam face 119*a*, a pair of left and right knitting cams 120A and 120B provided for up and down sliding movement in a truncated inverted V-shaped arrangement on the opposite sides of the transfer guide cam 119 and needle raising cam 118, and a lower slider guide cam 122, a middle slider guide cam 121 and an upper slider guide cam 123 provided at three stages above the transfer guide cam 119. The lower slider guide cam 122 has a bow-shaped arcuate face 122*a* provided at the center of a lower portion thereof and having the same shape as a bow-shaped arcuate needle butt raising face 118*c* provided at a top portion of the needle raising cam 118, a slider butt path 122*b* of a half height contiguous to the bow-shaped arcuate face 122*a*, a pair of inclined faces 122*c* at the opposite ends of the slider butt path 122*b*, and a pair of slider lowering inclined faces 122*d*, and the middle guide cam 121 is located above the lower slider guide cam 122.

The upper slider guide cam 123 is located above the middle guide cam 121 and has a guide face 123*a* formed to define a mountain-shaped recessed portion at a mid portion thereof, and the opposite ends of the upper slider guide cam 123 fall in such a configuration that they cover over the opposite sides of the middle guide cam 121 and lower slider guide cam 122 such that a pair of lowering guide faces 123*b* are provided thereon. The lowering guide faces 123*b* have a half height, and loop increasing lowering guide faces 123*c* are provided in parallel to the lowering guide faces 123*b*. The loop increasing lowering guide faces 123*c* have a full height.

Meanwhile, located below the needle raising cam 118 are a pair of pressers 128A and 128B which act upon the selector jack butt 111 at its knit position to sink the butt 110 of the corresponding needle 102 to its half position, a pair of pressers 124A and 124B which act upon the select jack butt 111 at its tuck position to sink the same, and a presser 125 which acts upon the select jack butt 111 at its welt position and has a greater width than the raising cam 118.

The knitting cams 120A and 120B are supported symmetrically in an opposing relationship to the raising cam faces 118*a* and 118*b* of the raising cam 118 so that they may be slidably moved upwardly and downwardly on the cam plate 140.

In the following, description will be given of the knitting cam 120B. The knitting cam 120B has a face opposing to the raising cam face 118*b* of the raising cam 118 which serves as a loop forming lowering cam face 120*a*, and a central portion thereof is formed as a recessed portion 129 having a half height while an inclined face 130 is constructed which extends from a portion located a little inwardly of the loop forming lowering cam face 120*a* towards the recessed portion 129. Meanwhile, at a lower end portion of the knitting cam 120B contiguous to the lowering cam face 120*a*, a stepped portion 131 of a height with which the butt at its half position can pass therethrough is formed such that a needle having a butt of a height to a half position can be lowered only to the stepped portion 131 but another needle having a butt of a height to a full position can be lowered to a lowermost end portion 132 so that a knit fabric can be produced which has a variation in density.

Further, an extension 133 which extends into the recessed portion 129 of the knitting cam 120B is provided on the guide cam 134. The extension 133 has a lowering cam face 133*a* on one side thereof, and the transfer receiving needle lowering cam face 133*a* extends in parallel to the loop forming lowering cam face 120*a* of the knitting cam 120B. Reference numeral 135 denotes a guide cam.

Figure 23:
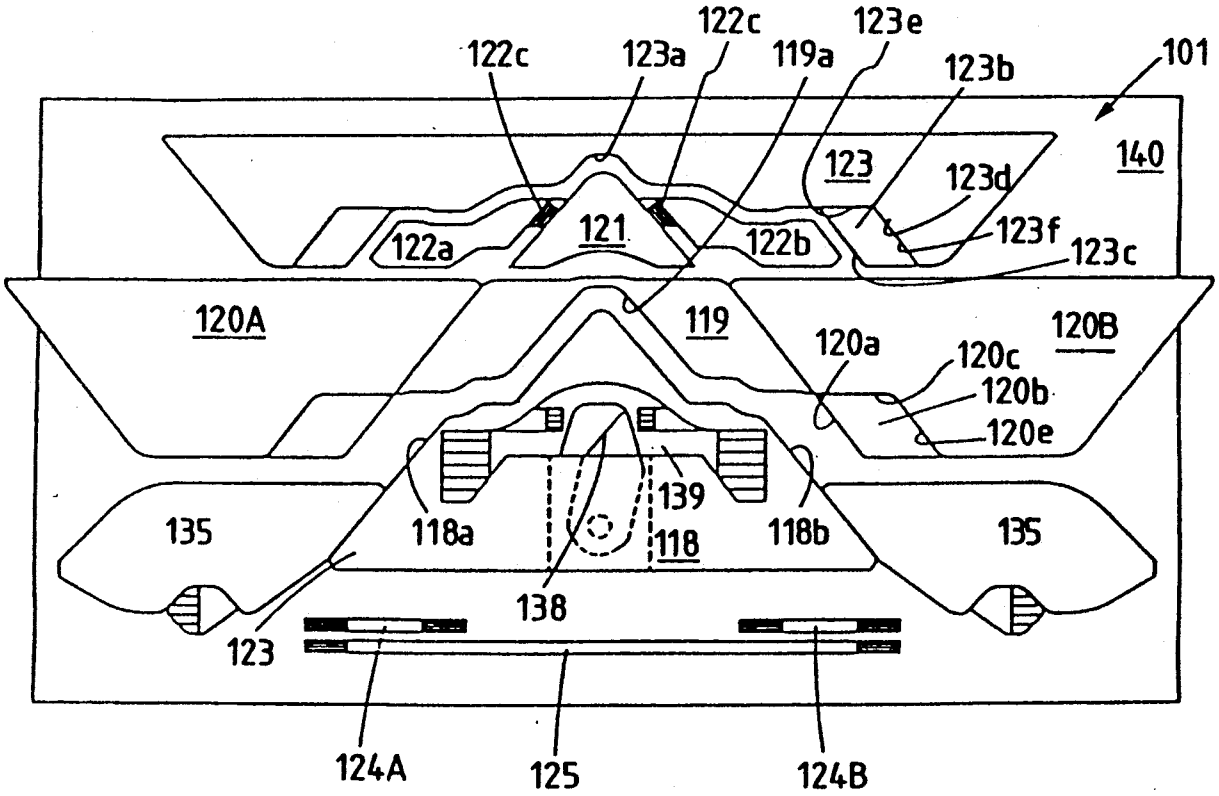
FIG. 23 is a plan view showing a cam lock of a carriage according to a fourth embodiment as viewed from below.

The needle operating cam for a flat knitting machine of the fourth embodiment according to the present invention shown in FIG. 23 can perform transfer and knitting of an increased loop simultaneously, and a cam lock 101 provided on a cam plate 140 includes a needle raising cam 118 having a trapezoidal shape wherein the opposite side inclined faces serve as raising cam faces 118*a* and 118*b*, a trapezoidal guide cam 119 disposed on the same center line as the needle raising cam 118 and having a mountain-shaped concave cam face 119*a*, a pair of fixed guide cams 120A and 120B provided on the opposite sides of the guide cam 119 and needle raising cam 118, and a middle guide cam 121, a pair of slider guide cams 122*a* and 122*b* and an upper slider guide cam 123 provided above the guide cam 119.

Meanwhile, a transfer lock 123 includes a cam face 138 formed in a mountain-shape at the center of the needle raising cam 118, and a transfer guide cam 119.

Each of the fixed guide cams 120A and 120B has a lowering guide face 120*a* on the inner side of a lower portion thereof, and the lowering guide face 120*b* has a half height of a parallelogram shape while a guide face of the lowering guide face 120*a* for a needle butt 110 is composed of an upper horizontal guide face 120*c* and an inclined guide face 120*e*.

The middle guide cam 121 is located above the guide cam 119 and has a substantially triangular shape, and the slider guide cams 122*a* and 122*b* are provided on the opposite sides of the middle guide cam 121. An inclined face 122*c* for guiding a slider butt is formed at each of portions of the middle guide cam 121 which are engaged with the slider guide cams 122*a* and 122*b*.

The upper slider guide cam 123 is located above the slider guide cams 122*a* and 122*b* and middle guide cam 121 and has a guide face 123*a* formed to define a mountain-shaped recessed portion at a mid portion thereof, and the opposite ends of the upper slider guide cam 123 fall in such a configuration that they cover over the opposite sides of the middle guide cam 121 and lower slider guide cams 122 such that a pair of loop increasing lowering guide face portions 123*b* are provided on the inner sides of lower portions thereof. The loop increasing lowering guide face portions 123*b* have a half height of a parallelogram shape and each has a lowering guide face 123*c* and a loop increasing guide face 123*d* for guiding the slider butt 108. The loop increasing guide face 123*d* is composed of an upper horizontal guide face portion 123*e* and an inclined guide face portion 120*f*.

Located below the needle raising cam 118 are a pair of pressers 124A and 124B which act upon the select jack butt 111 at its tuck position to sink the same, and another presser 125 which acts upon the select jack butt 111 at its welt position and has a greater width than the needle raising cam 118. Reference numeral 35 denotes a guide cam.

Subsequently, operation of the needle operating cams for a flat knitting machine described above will be described based on the needle operating cam for a flat knitting machine of the third embodiment.

Figures 24A, 24B:
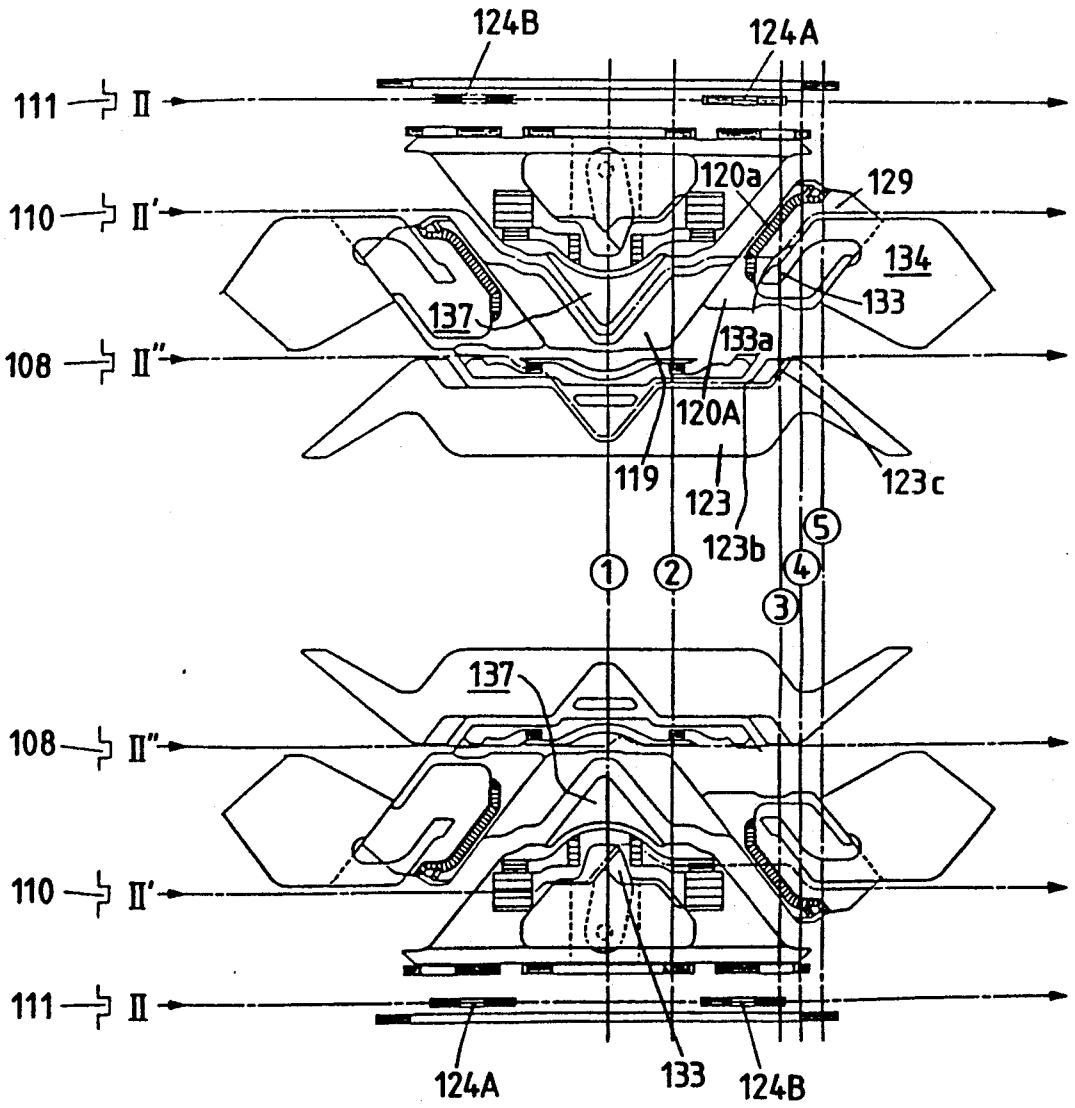
FIG. 24*a* and FIG. 24*b* are bottom plan views of the cam locks showing loci of needles on the delivering side and receiving side of the needle operating cam for a flat knitting machine of the third embodiment.

In FIGS. 24A and 24*b*, an example is shown wherein a stitch is increased from the cam lock shown at an upper portion to the other cam lock shown at a lower portion.

The cam lock shown in FIG. 24*a* will be hereinafter referred to as the delivering side while the cam lock shown in FIG. 24*b* will be hereinafter referred to as the receiving side. On the receiving side, the pressers 124A and 124B, loop delivering raising cam 137 and so forth assume the same positions as those upon transfer. On the delivering side, the trailing side presser 124A and loop delivering raising cam 137 are positioned to respective operative positions while the leading side presser 124*b* is positioned to its inoperative position. The carriage advances in the direction indicated by an arrow mark, and select jack butts 111, needle butts 110 and slider butts 108 follow the courses of alternate long and short dash lines indicated by II, II' and II'', respectively.

First, the body of the needle FB on the delivering side having the loop fb thereon is raised by the course of II'. In this instance, since the raising amount of the slider butt 108 is smaller comparing with the raising amount of the needle butt 110, the slider lowers and the hook is opened as the needle body is raised. Consequently, the loop fb carried in the hook slips in the hook and is arrested by a stepped portion 160 of the needle FB.

Thereupon, the needle BB on the receiving side opposing to the needle FB is raised by the loop receiving needle raising cam 133 similarly as upon transfer so that the hook 109 thereof is inserted into a blade 161 of the needle FB, thereby to insert the hook 109 into the loop fb (the position of 1 shown in FIG. 24 and 1 of FIG. 25).

Subsequently, the needle FB on the delivering side is lowered by the guide cam 119 while the slider 107 is lowered along guide face 123*a* of the upper slide guide cam 123, and even in a condition in which lowering movement of the slider 107 is stopped, the needle FB continues to be lowered and the hook 109 keeps its open condition. By lowering movement of the needle FB and slider 107 as described above, the loop fb will slip down into the hook 109 (the position of 2 shown in FIG. 24 and 2 of FIG. 25).

By succeeding movement of the carriage, the select jack butt 111 of the needle FB on the delivering side is engaged with and sunk by the presser 124A. Consequently, the needle butt 110 is pushed into the needle trick and thus jumps the cam face 120*a* of the knitting cam 120A and enters the recessed portion 129, and then it is engaged with the lowering cam face 133*a* of the extension 133 of the guide cam 134.

Since also the slider butt 108 is sunk then, it is not engaged with the lowering cam face 123*b* of the upper slider guide cam 123, and as the select jack butt 111 is disengaged from the presser 124A and the slider butt 108 comes out of the needle groove and is thus engaged with the lowering cam face 123C, the slider is lowered and the hook is opened, and the loop fb is caught by the hook 109 of the needle FB (the position of ③ shown in FIG. 24 and ③ of FIG. 26), whereafter both of the needles FB and BB are lowered further.

As a result, the loop fb, which is not carried, in normal transfer, on the needle FB at this position, remains carried on the hook of the needle FB (the position of ④ shown in FIG. 24 and ④ of FIG. 25).

Then, as both of the needles FB and BB are further lowered, the loop fb carried on the hooks of both of the needles makes loops fb and fb1 (the position of ⑤ shown in FIG. 24 and ⑤ of FIG. 25).

Consequently, an increased stitch is made, and such increased stitch can be utilized in a case in which a knitting width is to be increased as in fashioned knitting or the like.

In FIGS. 26*a* and 26*b*, courses II, II' and II" followed by the select jack butt 111, needle butt 110 and slider butt 108 of the needle operating cam for a flat knitting machine of the second embodiment described above are indicated by alternate long and short dash lines. While the construction of the cam locks of the present embodiment is different from the construction of the cam locks of the third embodiment described above, actions to perform knitting of an increased stitch when the select jack butt 111, needle butt 110 and slider butt 108 follow the paths indicated by the alternate long and short dash lines in the figures are similar to the actions in the third embodiment described hereinabove.

Meanwhile, in FIG. 27*a* and 27*b*, courses II, II' and II" followed by the select jack butt 111, needle butt 110 and slider butt 108 of the needle operating cam for a flat knitting machine of the fourth embodiment described above are indicated by alternate long and short dash lines. While also the construction of the cam locks of the present embodiment is different from the construction of the cam locks of the third embodiment described above, actions to perform knitting of an increased loop when the select jack butt 111, needle butt 110 and slider butt 108 follow the paths indicated by the alternate long and short dash lines in the figures are similar to the actions in the third embodiment described hereinabove.

As described so far, a needle operating cam for a flat knitting machine for operating needle bodies and sliders of compound needles separately from each other is constructed such that, for a lowering face of a needle body lowering cam of a loop delivering side cam, a slider lowering face for lowering a slider at a timing earlier than that by the lowering face of the needle body lowering cam is provided. Accordingly, performed only by hand knitting can be performed automatically on the flat knitting machine. Meanwhile, it may be provided on a carriage independently as a needle operating cam for a flat knitting machine for the exclusive use for the stitch increasing.

Meanwhile, a needle operating cam for a flat knitting machine which has a knitting lock and operates for needle bodies and sliders of compound needles separately from each other is constructed such that, for a lowering face of a needle body lowering cam of a loop delivering side cam, a slider lowering face for lowering a slider at a timing earlier than that by the lowering face of the needle body lowering cam is provided. Accordingly, knitting and stitch increasing can be performed with the needle operating cam for a flat knitting machine.

Further, a needle operating cam for a flat knitting machine which has a transfer lock and operates needle bodies and sliders of compound needles separately from each other is constructed such that, for a lowering face of a needle body lowering cam of a loop delivering side cam, a slider lowering face for lowering a slider at a timing earlier than that by the lowering face of the needle body lowering cam is provided. Accordingly, transfer and stitch increasing can be performed simultaneously with the needle operating cam for a flat knitting machine.

Further, various knitting operations can be performed simultaneously by provision of the needle operating cams for a flat knitting machine described above in combination on a carriage.

What is claimed is:

1. A stitch increasing method for a flat knitting machine which comprises a pair of opposed front and back needle beds, a plurality of compound needles disposed equally spaced in each said front and back needle beds wherein each of said plurality of needles comprises a needle body having a hook portion and a slider having a latch portion movable relative to said needle body over a given stroke such that the latch portion of the slider is brought into and out of engagement with the hook portion of the needle body to close and open the hook portion, and cam means disposed on each said front and back needle beds for operably moving each of said plurality of needles on each said front and back needle beds along an axis to transfer loops from compound needles on one of said front and back needle beds to the needles of the other of said front and back needle beds, said method comprising the steps of raising a delivery needle which carrier a loop on one of said front and back needle beds to a transfer position, raising a confronting transfer needle on the other of said front and back needle beds into the loop carried by the delivery needle, engaging the loop by the hook portion of both the delivery needle and the transfer needle, lowering the delivery needle and the transfer needle so that a portion of the loop is carried respectively by both the delivery needle and the transfer needle to extend between the front and back needle beds, relatively moving said front and back needle beds in either a first or second direction transverse to the axis along which each of said needles move, and transferring the portion of the loop carried by the transfer needle to a needle on the one of the front and back needle beds adjacent the delivery needle so that the loop is carried by adjacent needles on the one of the front and back needle beds.

2. The method of claim 1 comprising the steps of relatively moving said front and back needle beds in the first direction, and transferring the portion of the loop carried by the transfer needle to a needle adjacent the delivery needle so that an open loop is formed and carried by adjacent needles on the one of the front and back needle beds.

3. The method of claim 1 comprising the steps of relatively moving said front and back needle beds in the second direction, and transferring the portion of the loop carried by the transfer needle to a needle adjacent the delivery needle so that a closed loop is formed and carried by adjacent needles on the one of the front and back needle beds.

4. The method of claim 1 comprising the steps of relatively moving said front and back needle beds in the first direction a distance equal to the spacing between each of said needles, transferring the portion of the loop carried by the transfer needle to a needle adjacent the delivery needle in the first direction so that the loop is carried by adjacent needles on the one of said front and back needle beds, relatively moving said front and back needle beds in the second direction a distance equal to half the spacing between each of said needles, transferring a portion of the lop to the transfer needle, relatively moving said front and back needle beds in the second direction a distance equal to half the spacing between each of said needles, transferring loops carried by the delivery needle and an adjacent needle in the second direction to adjacent needles on the other said front and back needle beds, relatively moving said front and back needle beds in the second direction a distance equal to the spacing between each of said needles, and transferring the loops carried by the needles on the other of said front and back needle beds to the delivery needle and the adjacent needle in the second direction.

5. The method of claim 1 comprising the steps of relatively moving said front and back needle beds in the first direction a distance equal to the spacing between two of said needles, and transferring the portion of the loop carried by the transfer needle to a plurality of needles adjacent the delivery needle in the first direction so that the loop is carried by a plurality of adjacent needles on the one of said front and back needle beds.

* * * * *